US008016999B2

(12) United States Patent
Borgna et al.

(10) Patent No.: US 8,016,999 B2
(45) Date of Patent: Sep. 13, 2011

(54) PROCESS FOR REMOVING SULFUR FROM FUELS

(75) Inventors: Armando Borgna, Jurong Island (SG); Chuandayani Gunawan Gwie, Jurong Island (SG); Silvia Dewiyanti, Jurong Island (SG); Jeyagowry Thirugnanasampanthar, Jurong Island (SG)

(73) Assignee: Agency For Science, Technology and Research, Singapore (SG)

( * ) Notice: Subject to any disclaimer, the term of this patent is extended or adjusted under 35 U.S.C. 154(b) by 63 days.

(21) Appl. No.: 12/478,733

(22) Filed: Jun. 4, 2009

(65) Prior Publication Data

US 2010/0025301 A1 Feb. 4, 2010

Related U.S. Application Data

(63) Continuation-in-part of application No. 11/598,000, filed as application No. PCT/SG2004/000160 on May 31, 2004.

(51) Int. Cl.
*C10G 27/04* (2006.01)
*C10G 29/04* (2006.01)
*C10G 29/16* (2006.01)

(52) U.S. Cl. ..... 208/249; 208/208 R; 208/243; 208/244

(58) Field of Classification Search ..... 208/208 R, 208/243, 244, 249
See application file for complete search history.

(56) References Cited

U.S. PATENT DOCUMENTS

| | | | | |
|---|---|---|---|---|
| 3,847,800 | A | 11/1974 | Guth et al. | 208/236 |
| 4,459,204 | A | 7/1984 | Hecker et al. | 208/191 |
| 5,958,224 | A | 9/1999 | Ho et al. | 208/240 |
| 6,160,193 | A | 12/2000 | Gore | 585/833 |
| 6,171,478 | B1 | 1/2001 | Cabrera et al. | 208/212 |
| 6,277,271 | B1 | 8/2001 | Kocal | 208/212 |
| 6,368,495 | B1 | 4/2002 | Kocal et al. | 208/240 |
| 6,402,940 | B1 | 6/2002 | Rappas | 208/240 |
| 6,673,236 | B2 | 1/2004 | Stanciulescu et al. | 208/208 R |
| 2003/0010674 | A1 * | 1/2003 | Hagen et al. | 208/3 |
| 2004/0007506 | A1 | 1/2004 | Song et al. | 208/244 |
| 2006/0108263 | A1 | 5/2006 | Lin et al. | 208/219 |
| 2006/0226049 | A1 | 10/2006 | Nemeth et al. | 208/208 R |
| 2010/0038285 | A1 * | 2/2010 | Toledo Antonio et al. | 208/143 |

FOREIGN PATENT DOCUMENTS

EP 0 565 324 A1 10/1993

(Continued)

OTHER PUBLICATIONS

Murphy et al., "Controlling the Aspect Ratio of Inorganic Nanorods and Nanowires," *Advanced Materials*, 14(1):80-82, 2002.

(Continued)

*Primary Examiner* — Walter D Griffin
*Assistant Examiner* — Renee Robinson
(74) *Attorney, Agent, or Firm* — Seed IP Law Group PLLC

(57) ABSTRACT

Provided are processes for removing sulfur-containing compounds from fuel, comprising contacting the fuel in liquid phase with air to oxidize the sulfur-containing compounds, the contacting being carried out in the presence of at least one transition metal oxide catalyst, wherein the catalyst is supported on a porous support and wherein the porous support comprises a support material selected from the group consisting of a titanium oxide, a manganese oxide and a nanostructured material of the aforementioned support materials.

24 Claims, 23 Drawing Sheets

FOREIGN PATENT DOCUMENTS

| | | | | |
|---|---|---|---|---|
| EP | 1 403 358 | A1 | | 3/2004 |
| GB | 438354 | | | 11/1935 |
| GB | 1 404 513 | | | 8/1975 |
| GB | 2 105 742 | A1 | | 3/1983 |
| JP | 2001-354978 | A1 | | 12/2001 |
| WO | 96/09891 | A1 | | 4/1996 |
| WO | 02/079373 | A1 | | 10/2002 |
| WO | 03/051798 | A1 | | 6/2003 |
| WO | WO 2005/035117 | | * | 4/2005 |

OTHER PUBLICATIONS

Sampanthar et al., "A novel oxidative desulfurization process to remove refractory sulfur compounds from diesel fuel," *Applied Catalysis B: Environmental 63*:85-93, 2005.

Shiraishi et al., "Desulfurization and Denitrogenation Process for Light Oils Based on Chemical Oxidation followed by Liquid-Liquid Extraction," *Ind. Eng. Chem. Res. 41*:4362-4375, 2002.

* cited by examiner

| Sample code | Surface area ($m^2/g$) | TPV (ml) | APS (nm) |
|---|---|---|---|
| Gamma-$Al_2O_3$ | 377 | 0.87 | 9.3 |
| $Al_2O_3$/2%$MnO_2$ (uncalcined) | 378 | 0.84 | 5.3 |
| $Al_2O_3$/2%$MnO_2$ (calcined at 550 C) | 341 | 0.86 | 2.4 |
| $Al_2O_3$/5%$MnO_2$ (uncalcined) | 360 | 0.72 | |
| $Al_2O_3$/5%$MnO_2$ (calcined at 550 C) | 350 | 0.86 | 5.8 |
| $Al_2O_3$/8%$MnO_2$ (uncalcined) | 273 | 0.67 | |
| $Al_2O_3$/5%$MnO_2$ (calcined at 550 C) | 311 | 0.78 | 3.4 |
| $Al_2O_3$/11%$MnO_2$ (uncalcined) | 316 | | |
| $Al_2O_3$/13%$MnO_2$ (calcined at 550 C) | 305 | | |
| $Al_2O_3$/2%Co3O4 (calcined at 550 C)) | 320 | | |
| $Al_2O_3$/2%Co3O4 (calcined at 550 C) | 353 | 0.87 | |
| $Al_2O_3$/5%Co3O4 (uncalcined) | 302 | | |
| $Al_2O_3$/5%Co3O4 (calcined at 550 C) | 351 | 0.85 | |
| $Al_2O_3$/8%Co3O4 (uncalcined) | 275 | | |
| $Al_2O_3$/8%Co3O4 (calcined at 550 C) | 323 | | |

*FIG. 4*

GC results of the model diesel before oxidation (A), after oxidation (B) and after extraction by NMP, the n-tetradecane layer (C) and the NMP layer (D).

Conversion of DBT vs. time in model diesel at 130°C for manganese (■)- and cobalt (◆)-containing catalysts

| Sample | S (ppm) |
|---|---|
| Diesel (25 ml) extracted with AcN (10ml) | 337 |
| Diesel (25 ml) extracted with DMF (10ml) | 246 |
| Diesel (25 ml) extracted with NMP (10ml) | 239 |
| Diesel (25 ml) extracted with MeOH (25ml) | 342 |

*FIG. 8B*

| Catalyst | Extraction solvent | S (ppm) |
|---|---|---|
| ~2% $Co_3O_4$/γ-alumina | AcN (10ml) | 258 |
| ~2% $Co_3O_4$/γ-alumina | DMF (10ml) | 160 |
| ~2% $Co_3O_4$/γ-alumina | NMP (10ml) | 144 |
| ~2% $Co_3O_4$/γ-alumina | MeOH (25 ml) | 239 |
| ~5% $Co_3O_4$/γ-alumina | AcN (10ml) | 262 |
| ~5% $Co_3O_4$/γ-alumina | DMF (10ml) | 162 |
| ~5% $Co_3O_4$/γ-alumina | NMP (10ml) | 149 |
| ~5% $Co_3O_4$/γ-alumina | MeOH (25 ml) | 239 |
| ~8% $MnO_2$/γ-alumina | AcN (10ml) | 220 |
| ~8% $MnO_2$/γ-alumina | DMF (10ml) | 130 |
| ~8% $MnO_2$/γ-alumina | NMP (10ml) | 121 |
| ~8% $MnO_2$/γ-alumina | MeOH (25 ml) | 192 |

*FIG. 9*

| Catalyst | $R^n$ Temp. | Extraction solvent | S (ppm)[#] |
|---|---|---|---|
| ~2% $MnO_2$/γ-alumina | 130 deg C | NMP (10ml x 3) | 71 (72) |
| ~2% $MnO_2$/γ-alumina | 130 deg C | NMP (10ml) | 209 |
| ~2% $MnO_2$/γ-alumina | 130 deg C | NMP (20ml) | 140 |
| ~2% $MnO_2$/γ-alumina [3Ci] | 130 deg C | NMP (30 ml) | 107 |
| ~2% $MnO_2$/γ-alumina | 130 deg C | DMF (10ml) | 126 (115) |
| ~5% $MnO_2$/γ-alumina [3Cii] | 130 deg C | NMP(10ml x 3) | 58 (57) |
| ~5% $MnO_2$/γ-alumina [3Ciii] | 130 deg C | NMP (10ml) | 187 |
| ~5% $MnO_2$/γ-alumina | 130 deg C | DMF (10ml) | 208 |
| ~5% $MnO_2$/γ-alumina | 130 deg C | DMF (20ml) | 161 |
| ~5% $MnO_2$/γ-alumina | 130 deg C | DMF (30ml) | 128 |
| ~8% $MnO_2$/γ-alumina | 150 deg C | NMP (10 ml) | 159 |
| ~8% $MnO_2$/γ-alumina | 150 deg C | NMP (20 ml) | 133 |
| ~8% $MnO_2$/γ-alumina | 150 deg C | NMP (30 ml) | 115 |
| ~8% $MnO_2$/γ-alumina | 150 deg C | NMP (40 ml) | 75 (68) |

*FIG. 10*

| Catalyst | Catalyst amount (X mg) | Extraction solvent | S (ppm) |
|---|---|---|---|
| ~5% $MnO_2$/γ-alumina | ~150 mg | - | 347 |
| ~5% $MnO_2$/γ-alumina | ~150 mg | NMP (50ml) | 32 |
| ~8% $MnO_2$/γ-alumina | ~150 mg | - | 319 |
| ~8% $MnO_2$/γ-alumina | ~150 mg | NMP (50 ml) | 31 |
| ~8% $MnO_2$/γ-alumina | ~1 g | - | 324 |
| ~8% $MnO_2$/γ-alumina | ~1 g | NMP(50ml) | 16 |
| ~11% $MnO_2$/γ-alumina | ~150 mg | - | 353 |
| ~11% $MnO_2$/γ-alumina | ~150 mg | NMP (50ml) | 31 |
| ~13% $MnO_2$/γ-alumina | ~150 mg | - | 353 |
| ~13% $MnO_2$/γ-alumina | ~150 mg | NMP (50ml) | 39 |

*FIG. 12*

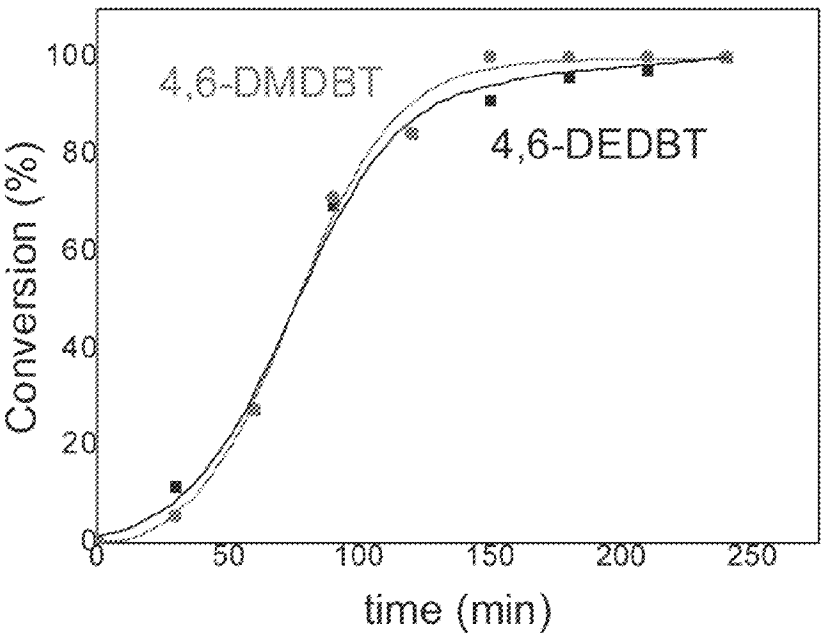
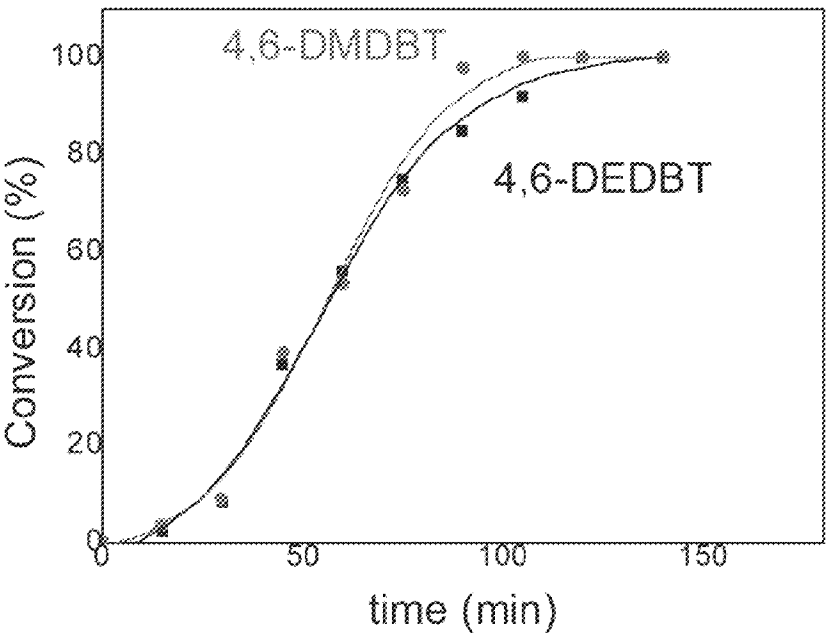
*FIG. 18*

PROCESS FOR REMOVING SULFUR FROM FUELS

CROSS-REFERENCE TO RELATED APPLICATIONS

This application is a continuation in part of U.S. Ser. No. 11/598,000 filed on Nov. 29, 2006 which is a national phase entry of PCT/SG2004/000160 (WO 2005/116169 A1) filed on May 31, 2004, the contents of them being hereby incorporated by reference in their entirety for all purposes.

BACKGROUND

1. Technical Field

This invention relates to a novel process for removing sulfur-containing organic compounds from fuels by oxidative desulfurization.

2. Description of the Related Art

For many years, growing concerns over environmental pollution caused by the presence of sulfur-containing compounds in hydrocarbon-based fuels such as diesel, gasoline, and kerosene has provided impetus for the development of desulfurization technology. A high level of sulfur in fuels is undesirable due to the formation of SOx from the combustion of sulfur-containing compounds. SOx in turn causes acid rain to form, leading to widespread damage to buildings and disturbing delicate balances in the ecosystem. Furthermore, sulfur compounds in fuels poison the noble metal catalysts used in automobile catalytic converters, causing fuel to be incompletely combusted and thus result in the emission of incompletely combusted hydrocarbons, carbon monoxide, nitrogen oxides in the vehicle exhaust, all of which are precursors of industrial smog.

To protect the environment against pollution caused by sulfur, governmental agencies have set up guidelines for petroleum refining companies to limit the level of sulfur in commercial fuels. For example, the United States Environmental Protection Agency (EPA) has recently announced plans to reduce sulfur content of diesel fuels from the current 500 parts per million (ppm) to 50 ppm in 2006.

The industrial removal of sulfur from fuels is generally carried out via the well-established hydro-desulfurization (HDS) process, described for example in the GB Patent 438,354. HDS involves the catalytic treatment of fuel with hydrogen to convert sulfur-containing compounds to hydrogen sulfide, $H_2S$. $H_2S$ is in turn converted to elemental sulfur by the Claus process. For low point and middle boiling point distillates, the typical HDS reaction requires relatively severe conditions of about 300° C. to 400° C. and 0.7 to 5 MPa.

It has been found that HDS is less effective in removing certain residual sulfur-containing compounds present in petroleum distillates, particularly heterocyclic sulfur-containing compounds such as thiophenes, benzothiophenes (BT), dibenzothiophenes (DBT), especially DBTs having alkyl substituents on their 4 and/or 6 positions (Ind. Eng. Chem. Res. 2002, 41, 4362-4375), as well as higher homologs of these compounds. One possible reason is that the sulfur atom is sterically hindered by the bulky benzyl groups, thereby making the sulfur atom less accessible to oxidative attack.

Although these heterocyclic sulfur compounds may be removed by optionally increasing the severity of HDS reaction conditions, the onset of other side reactions leading to the formation of coke, degradation of the octane level of the fuel, as well as the accompanying increase in energy and hydrogen consumption, makes the HDS option undesirable from an economic perspective.

Therefore, alternative processes have been developed to further lower sulfur content of fuels through the removal of residual sulfur-containing compounds from processed fuels, while maintaining or improving fuel performance. The term "deep desulfurization" is typically applied to such processes.

In general, deep desulfurization is carried out on fuels which have already undergone HDS and thus have sulfur contents that have been lowered from the initial level of several thousand ppm to several hundred ppm. Deep desulfurization is thus distinguished from conventional HDS in that it the oxidation of sulfur occurs at a sulfur concentration that is by comparison much lower. From the perspective of reaction kinetics, reactions that are first order or higher with respect to the reactant become more difficult to carry out as the concentration of the reactant becomes gradually lower.

One current approach to the deep desulfurization of fuels includes the use of transition metal adsorbents for removing the sulfur compounds, as disclosed in US Patent Application No. 2004/0007506, for example.

Another approach that has been investigated is oxidative desulfurization (ODS), in which fuel is contacted with oxidants such as hydrogen peroxide, ozone, nitrogen dioxide, and tert-butyl-hydroperoxide, in order to selectively oxidize the sulfur compounds present in the fuel to polar organic compounds. These polar compounds can be easily separated from the hydrophobic hydrocarbon based fuel via solvent (liquid) extraction using solvents such as alcohols, amines, ketones or aldehydes, for example.

U.S. Pat. No. 3,847,800 discloses an ODS process in which nitrogen dioxide gas is used as an oxidant to oxidize sulfur-containing compounds in diesel fuel. Methanol and ethanol are subsequently used as non-miscible solvents for extracting the oxidized compounds.

European Patent Application No. EP 0 565 324 A1 discloses a method of recovering organic sulfur compounds from liquid oil. The method involves a pure redox-based process between the sulfur compounds and the oxidant. The liquid oil to be processed is treated with an oxidizing agent, such as ozone gas, chlorine gas, peracetic acid or hydrogen peroxide to oxidize the sulfur compounds in the oil into sulfones or sulfoxides. Subsequently, the oxidized products are separated using a combination of means such as distillation, solvent extraction and adsorption.

The use of gaseous or liquid oxidants such as hydrogen peroxide, ozone, dioxirane and ethylene oxide to convert the sulfur compounds present in fuels into sulfones is also disclosed in U.S. Pat. No. 6,160,193. The oxidants are contacted with fuel in liquid phase, and the oxidized products thus formed are subsequently extracted from the fuel by adding dimethyl sulfoxide to the reaction mixture. According to this patent, when hydrogen peroxide is used as oxidant, metal catalysts can be used to accelerate the decomposition of the hydrogen peroxide to form the reactive oxidizing species. The dimethyl sulfoxide forms an aqueous phase which is separable from the hydrocarbon phase by gravity separation or centrifugation. Oxidation is reportedly carried out at about 30° C. to 100° C. at pressures of about 150 psig (about 12.5 bar) or preferably at a pressure of 30 psig (about 2.5 bar).

U.S. Pat. No. 6,402,940 further discloses a method for the oxidative removal of sulfur using an oxidizing aqueous solution that comprises hydrogen peroxide and formic acid in specific molar ratios. This oxidizing solution is mixed with liquid fuel at temperatures of 50 to 130° C., thereby oxidizing the sulfur compounds into polar compounds. The polar compounds are subsequently removed by simple extraction and phase separation.

Finally, the PCT application WO 03/051798 discloses a method for carrying out ODS in which the fuel and oxidant are contacted in the gas-phase. The fuel is first vaporized and then contacted with a supported metal oxide catalyst in the presence of oxygen. Sulfur is liberated from hydrocarbon molecules in the fuel as sulfur dioxide gas, which is subsequently removed with an ion exchange column.

BRIEF SUMMARY

Nevertheless, despite the developments that have taken place, alternative technologies need to be developed in order to reduce sulfur content in fuels while preferably maintaining/improving fuel performance without significant capital and operating costs. Accordingly, it is an object of the present invention to provide a corresponding process for removing sulfur-containing compounds in fuels in order to obtain fuels that have low sulfur content. It is a further object of the invention to provide a process for the effective removal of sulfur compounds from fuels which are not easily removed through conventional HDS processes, but is still economical to carry out on an industrial scale.

This object is solved by a process for removing sulfur-containing compounds from fuel, comprising:

contacting the fuel in liquid phase with air to oxidize the sulfur-containing compounds, said contacting being carried out in the presence of at least one transition metal oxide catalyst.

DETAILED DESCRIPTION

In oxidative desulfurization processes, the removal of sulfur-containing compounds from petroleum-based hydrocarbon fuels is carried out by oxidizing the sulfur-containing compounds using a suitable oxidant. The sulfur containing compounds are converted into compounds having increased polarity relative to the fuel, and then subsequently extracted. In the present invention, oxidation is accomplished by contacting liquid fuel with air in the presence of transition metal oxide catalysts that selectively facilitates the oxidation of the residual sulfur compounds.

One advantage of the invention comes from the use of gaseous oxygen found in air. While costly oxidants such as hydrogen peroxide or ozone are required in some of the current desulfurization processes, the present process only requires the use of air as oxidant. Since air is abundant and freely obtainable from the atmosphere, the present process can be carried out very economically. The use of air also eliminates the need to carry out any oxidant recovery process that is usually required if liquid oxidants such as hydrogen peroxide are used. Another advantage of the inventive process comes from treating fuel in liquid phase, which allows mild process conditions (low process temperatures and pressures) to be used for the efficient oxidation of sulfur compounds, as compared to other desulfurization processes known in the art in which more severe conditions are needed. Mild process conditions also mean that energy consumption for the process is low, thus resulting in further cost savings. Yet another advantage of the present invention is the ease of integration into any existing refinery for the production of diesel, as afforded by the mild process conditions of liquid phase contacting and the use of air. Furthermore, the use of a selective oxidation catalyst also permits the tuning of experimental parameters such as temperature and contacting time to achieve optimal conversion and selectivity. Conversions as high as 95% have been achieved in the present invention.

The present process is suitable for processing fuels having sulfur content ranging from several hundred to several thousand parts per million (ppm) by weight, effectively reducing the sulfur content to less than 100 ppm. Sulfur content of a fuel that is to be treated may vary, depending for example on the geographical location from which the original crude oil is obtained, as well as the type of fuel treated (e.g., whether the fuel is cracked or straight run). Depending on the sulfur level of the fuel to be treated, the present invention is sufficiently versatile to be implemented as a primary desulfurization process or as a secondary desulfurization process for treating fuels. Non-limiting examples of fuels which can be treated by this invention include gasoline, kerosene, diesel, jet fuel, furnace oils, lube oils and residual oils. Additionally, the fuels that can be processed are not limited to straight-run fractions, i.e., fractions obtained directly from atmospheric or vacuum distillation in refineries, but include cracked fuels and residues which are obtained from catalytic cracking of heavy crude oil fractions. As a primary desulfurization unit, the invention can substitute conventional HDS processes to process straight-run fuels which typically have high sulfur content of several thousand ppm, even up to 10000 ppm (1%) or more. As a secondary desulfurization unit, the present invention can be used for treating fuels that have been undergone HDS treatment and thus have sulfur content of 500 ppm or less. In one embodiment, HDS is first carried out to lower sulfur content to the range of about 300 to 800 ppm. Thereafter, the process of the present invention can be used to further lower sulfur content to less than 100 ppm or even less than 50 ppm, if desired. For economic reasons, the initial removal of high levels of sulfur from fuel is more suitably carried out by a conventional HDS process. In one embodiment, the fuel comprises diesel that has been treated in a hydrodesulfurization (HDS) process. In general, the present process is most preferably used for processing low viscosity fuels such as diesel and other fuels having viscosities that are comparable or lower than diesel. Nevertheless, if required, this process can still be applied to heavier fractions such as lube oils and residual oils.

In the context of the invention, the term 'lowered sulfur content' refers to fuel that has sulfur content of less than 500 ppm by weight. The present invention is able to reduce sulfur content in fuels to less than 500 ppm, preferably less than 200 ppm, and more preferably less than 100 ppm, and most preferably less than 50 ppm.

Sulfur-containing compounds that are typically found in petroleum fractions and which can be removed by the process of the invention include aliphatic or aromatic sulfur-containing compounds such as sulfides (e.g., diphenylsulfide, dibutylsulfide, methylphenylsulfide), disulfides, and mercaptans, as well as heterocyclic sulfur-containing compounds such as thiophene, benzothiophene (BT), dibenzothiophene (DBT), 4-methyl-dibenzothiophene (mDBT), 4,6-dimethyl-dibenzothiophene (dmDBT) and tribenzothiophene, and other derivatives thereof, for example. In one embodiment, sulfur containing compounds can also be characterized in that they comprise sulfur in the heterocyclic ring system, as it is the case in thiophenic compounds as the one listed above (BT, DBT etc.)

The oxidation of the above sulfur-containing compounds occur at varying degrees of ease. Simple sulfur-containing compounds such as aliphatic or aromatic mercaptans and sulfides are generally more easily oxidized than heterocyclic sulfur-containing compounds. Heterocyclic compounds typically comprise thiophenic substances such as thiophenes, BT, DBT, alkylated DBTs such as 4-methyl-dibenzothiophene, 4,6-dimethyl-dibenzothiophene as well as other higher boiling point derivatives. One possible reason for the resistance to oxidation in the latter class of sulfur-containing compounds is the shielding of the sulfur by bulky hydrocarbon structures in the molecule. This class of sulfur-containing compounds are not easily oxidized or decoupled from the hydrocarbons by means of conventional HDS processes, and have thus become known as 'hard' or 'refractory' sulfur compounds.

The conversion of thiophenic compounds into polar sulfones and/or sulfoxides using air as oxidant is the principal reaction carried out in the invention. The general reaction scheme for the ODS process is as follows:

(I)

$$R—S—R' \xrightarrow{[O]} R—SO_2—R' \xrightarrow{heat} R—R' + SO_2\uparrow$$

As can be seen from scheme (I), the sulfones can decompose to liberate $SO_2$, while leaving behind a useful hydrocarbon compounds that can be utilized.

Air is utilized in the present invention to oxidize the residual sulfur compounds mainly into their corresponding sulfones. While it is theoretically possible that some of the thiophenic sulfur compounds may be converted into other oxidized forms than sulfones, e.g., sulfoxides, gas chromatography data obtained from experiments according to the examples reveal that virtually no other sulfur compounds were formed. Without wishing to be bound by theory, it is believed that the sulfoxide species is unstable and will be oxidized into a corresponding sulfone by the process of the present invention. Accordingly, the present invention can be employed to convert sulfur compounds in fuels almost completely into sulfones, which can subsequently be extracted in a convenient manner. The oxidation of specific sulfur-containing compounds, particularly thiophenic compounds such as BT and DBT, which the present invention is effective in carrying out, is shown in the following illustrative reaction schemes:

(II)

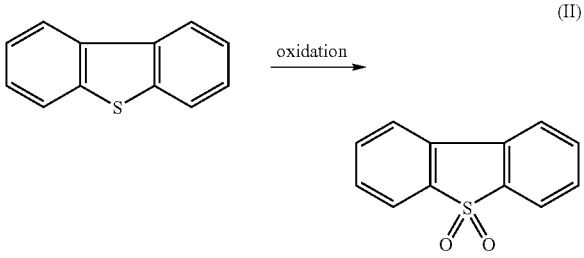

(III)

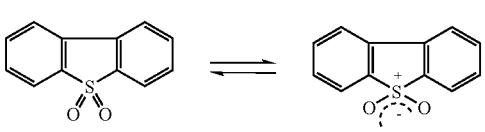

It can be seen from the reversible scheme (III) that the S═O bonds can be polarized due to the loss of an electron from the sulfur atom to the pair of electronegative double-bonded oxygen atoms. It is probable that these polar compounds do not exist in a single form, i.e., either as a non-polarized sulfone or a fully polarized compounds, but rather as compounds having an intermediate range of dipole moment values. As most of the other liquid phase components in the reaction mixture are non-polar in nature, the polar sulfone compounds can be easily separated using conventional separation methods such as solvent extraction or adsorption.

The contacting of fuel with air can typically be carried out in any suitable continuous flow or batch reactor. Suitable continuous-flow reactors can, for example, be any commercially available tubular or packed-bed column reactor. Typical single fixed bed catalyst packing configurations found in hydrodesulfurization processes can be used in the present invention. In order to provide uniform distribution of the catalyst in the reactor (thereby ensuring uniform temperature profile and gas pressure drop through the catalyst with no hot spots), the transition metal oxide catalyst can be held in any commercially available structured packing that can improve contact between the fuel, air and the metal oxide catalyst. The treated fuel leaving the ODS reactor contains both desulfurized fuel and oxidized sulfur compounds which can be readily separated by means of any suitable separation process such as solvent extraction or distillation. If a batch reactor is used, a fixed amount of fuel can be placed in the batch reactor while air is bubbled into the fuel. Once the reaction is complete, the oxidized sulfur compounds may be separated from the treated fuel using any suitable separation technique. If desired, treated fuel may be processed in a second run of the oxidation process to further reduce sulfur content in the fuel.

Generally, the contacting of fuel with air is carried out at a temperature range of between 90° C. to 250° C., more preferably from 90° C. to 200° C. The choice of the reaction temperature is typically influenced by factors such as the boiling range of the fuel being treated and the desired level of conversion. The boiling point of fuels that can be processed typically range from less than 100° C. to several hundred degrees Celsius. For example, if the boiling range of the fuel is above 180° C., a reaction temperature range of 130° C. to 180° C. is used. Fuels having such a boiling range include kerosene, diesel, gas oil and heavy gas oils. As noted above, one advantage of the present invention is that the treatment of fuel takes place in the liquid phase, meaning that the contacting generally takes place at temperatures lower than the boiling range of the fuel for a given reaction pressure. It is known that an elevated reaction temperature is desirable for improving the kinetics of the oxidation reaction, thereby obtaining higher conversion levels. However, due to the exothermicity of the oxidation reaction, high temperatures can be inhibitory from a thermodynamic viewpoint. Furthermore, an elevated temperature is associated with unwanted side reactions that can result in the formation of undesirable polymers and coke. Accordingly, an optimal reaction temperature range that takes into consideration these opposing factors would be beneficial in carrying out the invention.

In one embodiment, the contacting of fuel with air is carried out at a temperature range of about 110° C. to 190° C., and preferably between 130° C. and 180° C., and more preferably between 130° C. to 160° C. A particularly preferred temperature range is between 130° C. and 150° C., including about 130° C. to 140° C., or even more preferably about 140° C. Accordingly, in some particularly preferred embodiments in which diesel fuel is treated and supported cobalt or manganese oxide catalysts are used, a preferred reaction temperature is about 150° C. In another particularly preferred embodiment, a preferred reaction temperature is about 130° C.

The pressure at which contacting is carried out should generally be low, but at the same time sufficiently high to avoid flashing of the fuel in the reactor that is lost with the effluent air. In general, reaction pressures that are typically used in the invention may be between about 1 bar and 30 bar or between about 1 bar and 25 bar or 20 bar; or between about 1 bar and 10 bar. In one example the pressure is about 1 bar or may range from less than 1 bar to slightly above 1 bar (about 1.2 bar) or about 2.5 bar, 5 bar, 7.5 bar, 10 bar, 12.5 bar, 15 bar, 17.5 bar, 20 bar, 22.5 bar, 25 bar, 27.5 bar or about 30 bar. Carrying out the oxidation reaction at elevated reaction pressures may be advantageous as the elevated pressure may improve the oxidant concentration in the reaction system. In a preferred embodiment, the contacting takes place at a pressure above 1 bar.

Notwithstanding the fact that certain temperatures ranges and pressures are preferred in specific embodiments, it should be noted that in the broad practice of the invention, the oxidation of sulfur containing compounds present in fuel can be achieved even if reaction temperatures and pressures falling outside the above preferred ranges are used, though the conversion rate may not be optimal in such cases.

The oxidation reaction which is carried out in the present invention involves the use of air as the (sole) oxidant for carrying out the oxidation of sulfur-containing compounds in the fuel. It is noted that the term "air" as used herein is to be understood in its regular meaning. The term thus refers to a mixture of atmospheric gases comprising gases such as nitrogen, oxygen, carbon dioxide, trace amounts of other gases and optionally also water vapor. Gaseous oxygen is involved in the oxidation of the sulfur-containing compounds, while other gases such as nitrogen passes through the reactor without being involved in any reaction, given the mild reacting conditions of the process. In this respect, the oxygen content in air is typically known to be about 21% by volume, although this level of oxygen may vary. Accordingly, the oxygen content of air that is used here may be at about its regular level in the atmosphere, i.e., 21%. It may, however, also be lower, e.g., if oxygen depleted air is used, or may be higher, if oxygen enriched air is used. Depending of the oxygen level, the flow rate of air into the reaction environment can be adjusted dynamically by implementing a conventional feedback control, based for example based on the measured oxygen content of the air introduced into the reactor. Alternatively, instead of adjusting the flow rate of air into the reaction environment, the reaction environment can be dynamically supplemented with a high purity oxygen stream using a feedback control.

The present invention makes use of a transition metal oxide catalyst for the oxidation of the sulfur-containing compounds. In the present invention, any transition metal oxide exhibiting catalytic activity towards the oxidation of sulfur compounds, preferably hard sulfur compounds such as thiophenic compounds and the higher homologs thereof, may be used in the invention. Examples of suitable catalytic transition metal oxides include but is not limited to oxides of transition metals such as vanadium, chromium, manganese, cobalt, nickel, zirconium, niobium, molybdenum, rhenium, tantalum, and tungsten. Specific examples of transition metal oxides include $MnO_2$, $Cr_2O_3$, $V_2O_5$, $NiO_2$, $MoO_3$ and $CO_3O_4$. Chromates, vanadates, manganates, rhenates, molybdates and niobates of the transition metal may also be used as catalyst. Depending on factors such as cost and availability, preferred transition metal oxides are those that exhibit highly catalytic activity towards the selective oxidation of sulfur containing compounds, especially thiophenic compounds.

In one embodiment, the transition metal oxide is an oxide of a metal selected from Groups 6, 7, 8 or 9 of the Periodic Table (IUPAC 1990), with oxides of manganese, cobalt, iron and chromium being presently preferred in the invention. In addition, the catalyst may comprise a single transition metal oxide or a mixture of transition metal oxides. The transition metal oxide catalyst can be present in a single or in multiple oxidation states.

Solid catalysts are preferably used in the invention. The catalyst can be present in any useable form, such as powders, pellets, extruded structures, monoliths or crushed structures, for example. Conventional techniques can be used prepare the catalysts in the desired form for use in the present invention. For example, in order to prepare powder catalysts, it is possible to calcine the corresponding metal nitrates or metal acetates under static air for 3 hours, using a calcination temperature in the range of 500-600° C. in order to obtain the metal oxides. The heating rate can be pre-determined by thermal gravimetric analysis.

In certain embodiments of the invention, solid catalysts are preferably employed in the form of porous pellets. Porous catalyst pellets are commonly known and can be produced according to any conventional method. For example, it is possible to mix the catalyst components into a paste and extrude the paste as pellets, which are then baked at a high temperature. In order to obtain supported catalysts, it is possible to dope a support pellet with the transition metal oxide catalyst by immersing the support pellet in a salt solution of the transition metal. Additionally, pellets can adopt any suitable shape, including pellets that are spherical, cylindrical, star shaped or ring shaped, for example.

In one embodiment of the invention, the catalyst used is mounted/supported on a porous support. Supported catalysts are typically porous pellets having catalytic material deposited as a thin film onto its surface. The porous support can comprise a chemically inert material having no effect on the oxidation reaction, or it can comprise a material that exerts a promoting effect on the catalyst which it supports, thereby improving the oxidation ability of the catalyst, e.g., silica carrier promotes chromia catalyst. Whilst catalyst pellets can comprise solely of catalytic material, it is usually not economically attractive since a substantial mass of catalytic material remains locked within the pellet and is thus not effectively exposed for contact with reactants.

The use of a porous support helps to increase the surface area to volume ratio of the supported catalyst, thus providing a larger surface area for the oxidation reaction to take place. For this purpose, any variety of porous support may be used, including microporous ($d<2$ nm), mesoporous ($2<d<50$ nm) and macroporous ($d>50$ nm) supports. Materials which can be used as the porous support include metal oxides such as titania, alumina, ceria, magnesia, zirconia and tin oxide. Refractory materials that can withstand high reaction temperatures, such as ceramic materials, can also be used, and examples include silica or alumina based ceramic materials. Other suitable materials include activated carbon, as well as members of the zeolite mineral group, for instance Y-zeolites, mordenite, clinoptilolite, chabazite, and phillipsite. It is presently possible that the support comprises one single material or a mixture or combination of several materials, such as amorphous silica-alumina.

It is also possible to use a nanostructured support material made of any of the aforementioned materials. Nanostructured materials can have any form and have usually dimensions typically ranging from 1 to 100 nm (where 10 Ångstrom=1 nm=1/1000 micrometer). More specific, a nanostructured material has at least one dimension being less than 100 nm. They can be classified into the following dimensional types: zero dimensional (0D) including nanospherical particles (also called nanoparticles or (nano)spheres); one dimensional (1D) including nanorods, nanowires (also called nanofibers) and nanotubes; two dimensional (2D) including nanoflakes or nanodiscs and (3D) including coral-like nanostructures and nanoflowers.

Nanostructure materials can be obtained in many ways which are known in the art. One way to obtain different nanostructured materials is the use of hydrothermal reaction which uses an autoclave operating under elevated pressure.

The nanostructured material which can be used in the present invention includes, but is not limited to spheres (nanoparticles), nanocubes, nanotubes (hollow tubes having single or multiple walls, i.e., single-walled nanotubes or multi-walled nanotubes), nanowires (also called nanofibers), nanorods, nanoflakes, nanodiscs or combinations of the aforementioned nanostructured materials in a mixture. Nanotubes are hollow and can be single-walled or double-walled or multi-walled nanotubes. Examples of nanostructured materials include, but are not limited to $TiO_2$ nanowires or nanotubes, coral-like $\alpha$-$Mn_2O_3$ or $\alpha$-$MnO_2$ nanorods. As for a titanium oxide, such as $TiO_2$, it is also possible to use a powder of a titanium oxide. P25 is an example for a powder of $TiO_2$.

Different nanostructured materials can be differentiated not only by optical means according to their shape but also by their aspect ratio (see e.g., Murphy, C. J., Jana, N. R., 2002, Adv. Mater., vol. 14, no. 1, pp. 80). The aspect ratio of a nanostructured material is defined as the length of the major axis divided by the width of the minor axis. According to this definition, nanospheres have an aspect ratio of 1. Nanorods can be defined as a nanostructured material that have a width of about 1 to 100 nm and aspect ratios greater than 1 but less than 20 and nanowires are analogous materials that have aspect ratios greater than 20. On the other hand nanotubes can be more easily differentiated from nanowires and nanorods by the fact that they are hollow compared to nanorods and nanowires which are solid. An example of a three dimensional coral-like structure is illustrated in FIG. 19 which shows a coral-like $Mn_2O_3$ nanostructure.

In one embodiment in which manganese and/or cobalt oxide is used as the catalytic material, the support comprises aluminium oxide (alumina), preferably $\gamma$-alumina. Alumina supports can be in the form of pellets or extrudates, and can be obtained by any conventional method, such as drop coagulation of an alumina suspension, or via agglomeration.

Other support materials that can be used to serve as support for the transition metal oxide catalyst can include, but are not limited to a titanium oxide, a manganese oxide or nanostructured materials of the aforementioned oxides. A titanium oxide is for example TiO, $TiO_2$ or $Ti_2O_3$. In one embodiment $TiO_2$ can be used. Examples for manganese oxides include $MnO_2$ or $Mn_2O_3$, $Mn_3O_4$ and $Mn_2O_7$. In one embodiment $\alpha$-$Mn_2O_3$ or $\alpha$-$MnO_2$ can be used.

Specific combinations of catalyst and support that are suitable for use in the invention include $CoO/Al_2O_3$, $Co_3O_4/Al_2O_3$, $MnO_2/Al_2O_3$, $Mn_2O_3/Al_2O_3$, CoO; $Co_3O_4/Al_2O_3$, $Co_3O_4$; $MnO_2/Al_2O_3$, CoO; $MnO_2/Al_2O_3$, $CoO/SiO_2$, $Co_3O_4/SiO_2$, $MnO_2/SiO_2$, $Mn_2O_3/SiO_2$, CoO; $Co_3O_4/SiO_2$, $Co_3O_4$; $MnO_2/SiO_2$, CoO; $MnO_2/SiO_2$, $MoO_2/Al_2O_3$, $MoO_3/Al_2O_3$, $Ru/SiO_2$, Mg; $Al/SiO_2$, Co; $Al/SiO_2$, $Ni/SiO_2$, Mn; $Mo/TiO_2$, Mo/$\alpha$-$Mn_2O_3$, or Co; $Ni/Al_2O_3$, for example.

Apart from the selection of transition metal oxides to use as the catalyst, the choice of a suitable catalyst loading level can help to contribute to achieving an optimal oxidation of the sulfur-containing compounds. In this context, catalyst loading is defined as the weight percentage of transition metal oxide present with respect to the support, preferably with respect to the weight of the support before loading the support with the catalyst. Generally speaking, catalyst loading can be determined once calcination has been carried out on the catalyst in which the transition metal salt is converted into the corresponding transition metal oxide. For the ease of calculation of the catalyst loading, it is assumed in the present invention that the respective metal will be present after calcination as a homogenous oxide with a uniform oxidation state, for example as $MnO_2$, $NiO_2$, or $Co_3O_4$. Inductively coupled plasma spectroscopy (ICP) measurements can be made to determine the metal concentration in the catalysts. From those ICP measurements, the actual percentage of the metal oxide present can be calculated. Apart from ICP, the prepared catalysts can also be analyzed by Scanning Electron Microscopy (SEM) energy dispersive analysis by X-Ray (EDAX), which will give the surface composition of the catalyst. Loading levels that fall below the optimal range (which can be determined empirically by the skilled person), may result in lower yields, while loading levels that are increased above the empirically determined optimal range may provide diminishing returns in terms of conversion. In one embodiment of the invention, the catalyst loading is in the range of between about 1 to 30%, or between about 10 to 30%, or between about 20 to 30% or between about 25 to 30%, or between about 1 to 17%, or between about 2 to 13%, of the weight of the support used. In some examples, the catalyst loading can be about 1, 5, 7, 10, 13, 15, 17, 20, 23, 25, 27 or 30%. It should be noted that other catalyst loading values falling outside this range can nevertheless be used, even though they may be less than optimal and may thus place compensatory demands on other areas of the process. For example, if a low loading level is used, the corresponding low conversion of the sulfur-containing compounds may necessitate higher space time, temperature or pressure, consequently leading to increased reactor size or possible unwanted side reactions, respectively.

Where the catalysts used in the invention are to be mounted onto supports, any conventional impregnation method known in the art may be used to prepare the catalysts. Such methods include incipient wetness, adsorption, deposition and grafting. If the incipient wetness method is used, for example, a solution containing a salt of the catalytic transition metal is first prepared. The support on which the catalyst is to be mounted may be subjected to pre-drying at elevated temperatures overnight before impregnation. This drying step helps to remove the adsorbed moisture from the pores and to fully utilize the pores for efficient and uniform impregnation of the metal salt solution. The concentration of the salt solution is prepared according to the desired catalyst loading level. For example, in order to prepare a catalyst with a loading level of 5% $MnO_2$ supported on $\gamma$-alumina, that is 0.5 g of $MnO_2$ on 10 g $\gamma$-alumina, 10 g of pre-dried $\gamma$-alumina can be impregnated in a solution containing 1.409 g of Mn(II) acetate×$4H_2O$ (molecular weight 245.09) dissolved in 8.0 ml deionized water. As can be seen from this example, it is assumed for the calculation of the catalyst loading that the Mn salt is completely converted into $MnO_2$ during the subsequent calcination and that formation of mixed metal oxides such as $MnAl_2O_4$ can be neglected. The wetted support is subsequently left to dry. The drying may be carried out by baking the wetted supports in an oven to calcine the catalyst. Calcination of the metal salt leads to the formation of a layer of metal oxide on the support.

In order to form a catalyst comprising a homogeneous mixture of two or more transition metal oxides, it is possible to wet the support structures in a mixture containing the salts of two or more of the desired transition metals. On the other hand, if it is desired to disperse several layers of different transition metal oxides on the support, the impregnation and baking steps can be sequentially performed with the salt solution of each respective transition metal. In this context, the salt that is used to prepare a salt solution is known as the catalyst precursor. Suitable precursors include crystalline salts of the transition metal such as nitrates, chlorides, sulphates, bromides, iodides, phosphates, carbonates, as well as organic compounds of the metals, such as acetates, benzoates, acrylates and alkoxides. It should be noted that in order to form a solution using these salts, they should be water soluble or soluble in an organic solvent. Methods of preparing suitable supported or bulk catalysts for use in the present invention are described in Example 1 as well as taught in WO 03/051798 and the references cited therein, for example.

It is also contemplated that the catalyst formulation can additionally include other components, such as promoters which can enhance catalyst activity or prolong the process lifespan of the catalyst. It may also be desirable that the catalysts are presulfided before use.

The process of the present invention may be supplemented by other suitable pre- or post-treatment steps. For example, the fuel to be treated can be subjected to prior chemical or thermal treatment before it is contacted with air. It is also possible to pre-heat the process air prior to introducing the air into the reactor. Once the contacting has been performed, it is also possible to carry out a variety post-processing steps, such as separation steps to separate the oxidized sulfur compounds from the fuel or to remove any sulfur dioxide gas from the exhaust air prior to releasing it into the atmosphere.

In order to remove the oxidized sulfur compounds, of which a large percentage comprises sulfones, from the treated fuel, the polarity of the sulfone molecule is relied upon to extract the sulfones from the hydrocarbon organic phase into aqueous phase. Thus, one embodiment of the present invention further comprises adding a polar organic solvent to the treated fuel after contacting with air, thereby extracting the oxidized sulfur-containing compounds from the treated fuel, and separating the polar organic solvent and the oxidized sulfur-containing compounds from the treated fuel. This embodiment is based on liquid-liquid extraction using polar solvents that are insoluble in the hydrocarbon fuel. The choice of solvent is influenced by several factors, such as selectivity of the oxidized sulfur compounds in the solvent, density of the solvent, insolubility of the solvent in the treated fuel, and recoverability of the solvent. One factor to consider in choosing a solvent is the selectivity of the solvent towards the polar oxidized sulfur-containing compounds. Typically, organic compounds having high polarity, as observed from their Hildebrand's solubility parameter, are selective towards the solvation of the oxidized sulfur compounds. Selectivity of extraction is important because the extraction of valuable carbonyl and aromatic hydrocarbons from the fuel should be minimized. Apart from this consideration, the selected fuel should preferably also be one that is immiscible (partition coefficient) in the fuel and has a different density from the treated fuel, so that the fuel/solvent mixture can be easily separated by conventional means such as gravity separation or centrifugation. It may also be helpful to choose a solvent that has a boiling point that is different from the boiling point of the sulfones to be extracted, so that distillation can be readily carried out to separate the sulfones from the solvent subsequently.

Various types of equipment can be used for solvent extraction, and its selection can depend on factors such as cost, size of equipment or process throughput, for example. When carrying out large scale solvent extraction of the oxidized sulfur compounds, a single stage mixer-settlers can be used, or if better extraction is desired, multi-stage cascades may be used instead. Alternatively, sieve tray extraction towers may also be used.

In one embodiment of the extracting step, between about 1 to 4 parts by volume of fuel is contacted with about 1 part by volume of polar organic solvent. The quantity of solvent used in solvent extraction affects the extent of extraction. While increasing the quantity of solvent improves the extraction of the oxidized sulfur compounds from the fuel, this advantage is counteracted by other considerations such as increased costs due to the larger amounts of solvent being used as well as increase in the scale of solvent recovery operations.

Numerous polar organic substances can be used for the solvent extraction of the oxidized sulfur compounds. These include acetonitrile (AcN), dimethyl sulfoxide, N,N'-dimethyl-acetamide, N-methyl-pyrrolidinone, trimethylphosphate, hexamethylphosphoric amide, methanol (MeOH), ethanol, propanol, butanol, carbon disulfide, pyridine, propylene glycol, ethylene glycol or any mixture thereof etc. In one embodiment, the polar organic solvent comprises N,N'-dimethyl-formamide (DMF), 1-methyl-2-pyrrolidone (NMP), acetone or any mixture thereof. The solvent can also be diluted with water, if desired.

In general, the polar organic solvent and the dissolved oxidized sulfur compounds can be separated from the fuel by gravity separation or centrifuging. The organic solvent can subsequently be recovered using any conventional separation method, such as evaporation, distillation or chromatography, to recover the solvent for recycle. The desulfurized fuel can be further processed, such as by washing with water or adsorption using silica gel or alumina, to remove traces of the solvent. The fuel thus obtained has sulfur-content of typically less than 100 ppm, or preferably less than 50 ppm.

In one embodiment of the invention, the treated fuel is contacted with a basic adsorbent. The basic adsorbents used herein should exhibit a tendency towards the preferential adsorption of any acidic species present in the fuel. The contacting step in this embodiment can be advantageously carried out after the separation/extraction step to eliminate remaining traces of the sulfones in the fuel. As sulfones are weakly acidic in nature, the use of a basic adsorbent can remove them as well as other acidic impurities such as other sulfur-based or nitrogen-based impurities from the fuel. Examples of such basic adsorbents include zeolites, activated carbon, and layered-double hydroxides (LDH). LDHs are preferably used in some embodiments and examples of suitable LDHs include those based on the metals Mn, Co, Ni, Cr, Al, Mg, Cu, Zn and Zr coupled with exchangeable anions such as $NO_3^-$, $Co_3^{2-}$ and/or $Cl^-$, for example. The adsorption process can be carried out in any suitable furnace reactor, such as in a continuous flow tube furnace with the absorbent packed as a fixed bed. In order to regenerate the adsorbent, a base can be added to the adsorption column to regenerate the adsorbent. The overall recovery that can be achieved with a combination of solvent extraction and adsorption can be as high as 92%.

The invention will be further explained by the following non-limiting examples and the accompanying figures, in which:

FIG. 1 shows the simplified process flowsheet of the oxidative desulfurisation (ODS) process according to the invention.

FIG. 2 shows the process flowsheet of a specific embodiment of the ODS process according to the present invention. In this embodiment, ODS is carried out as a secondary desulfurization process for fuels that have been treated by conventional HDS. The treated fuel is channeled to a stirred/ mixing tank containing a solvent for removing the oxidised sulfur compounds. The fuel/solvent mixture is then channeled to a settler where the treated fuel is separated from the solvent.

FIG. 4 shows the results of the analysis of the prepared catalysts based on the Brunauer, Emmett and Teller (BET) method.

FIGS. 5A to 5D show the results of analysis carried out with a gas chromatography Flame Ionisation Detector (GC-FID) on model diesel before oxidation was carried out (a) and after oxidation was carried out using the present invention (b). After solvent extraction using NMP was performed, the fuel and the solvent layers were each analysed. Figures (c) and (d) shows the analysis results of the n-tetradecane layer the NMP layer, respectively.

Figure 6:
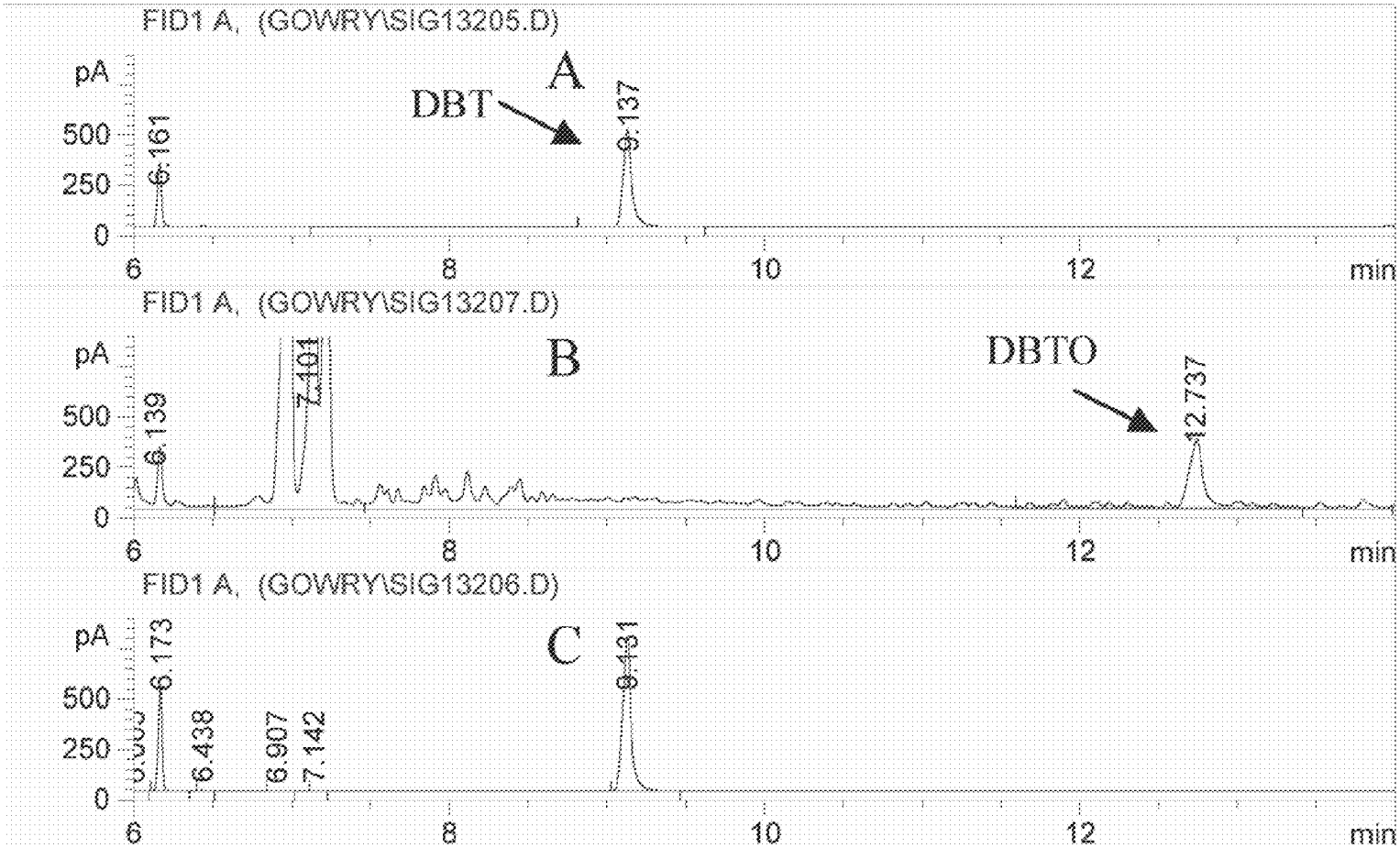
Figure 6:
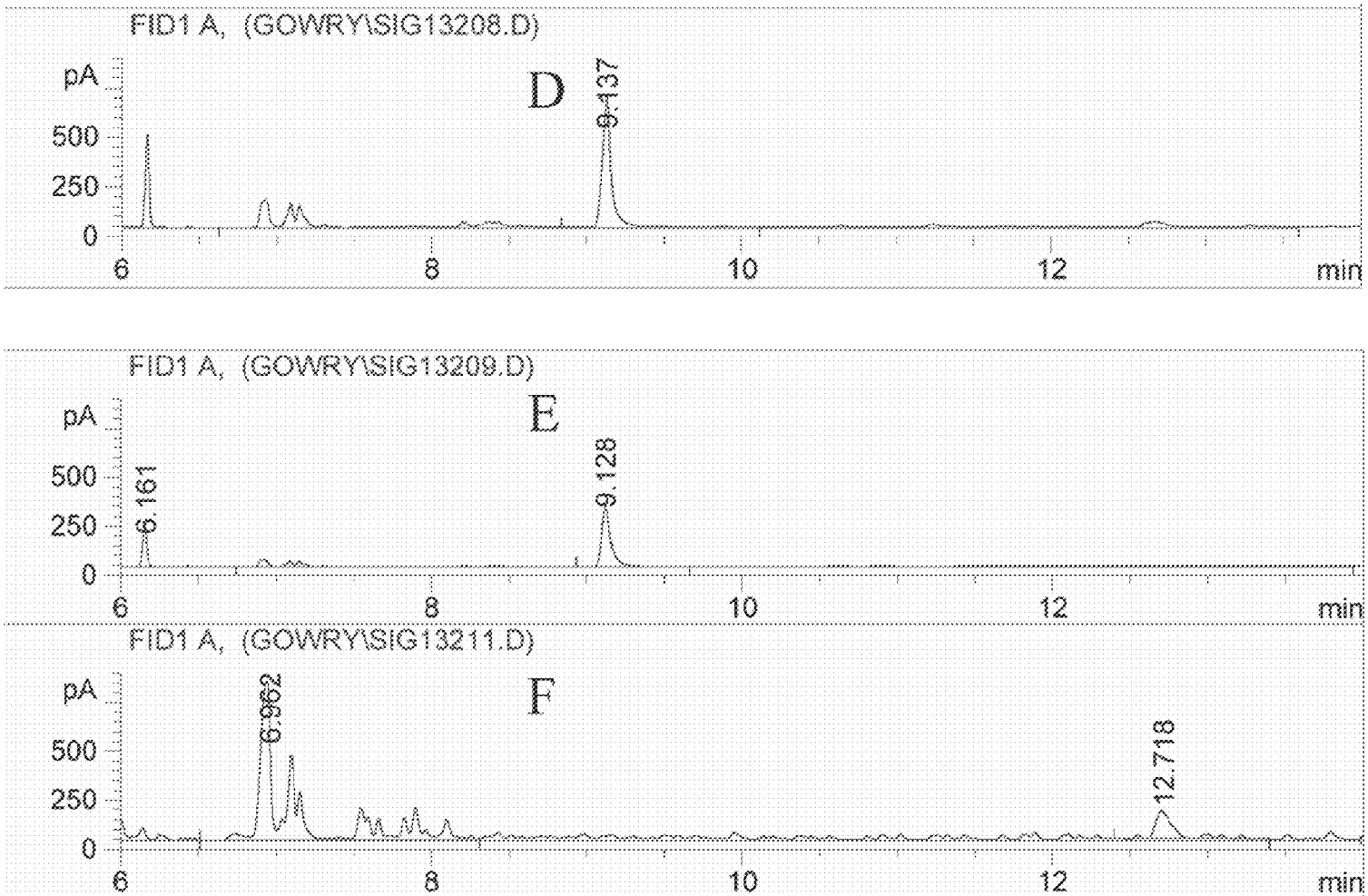
Figure 6:
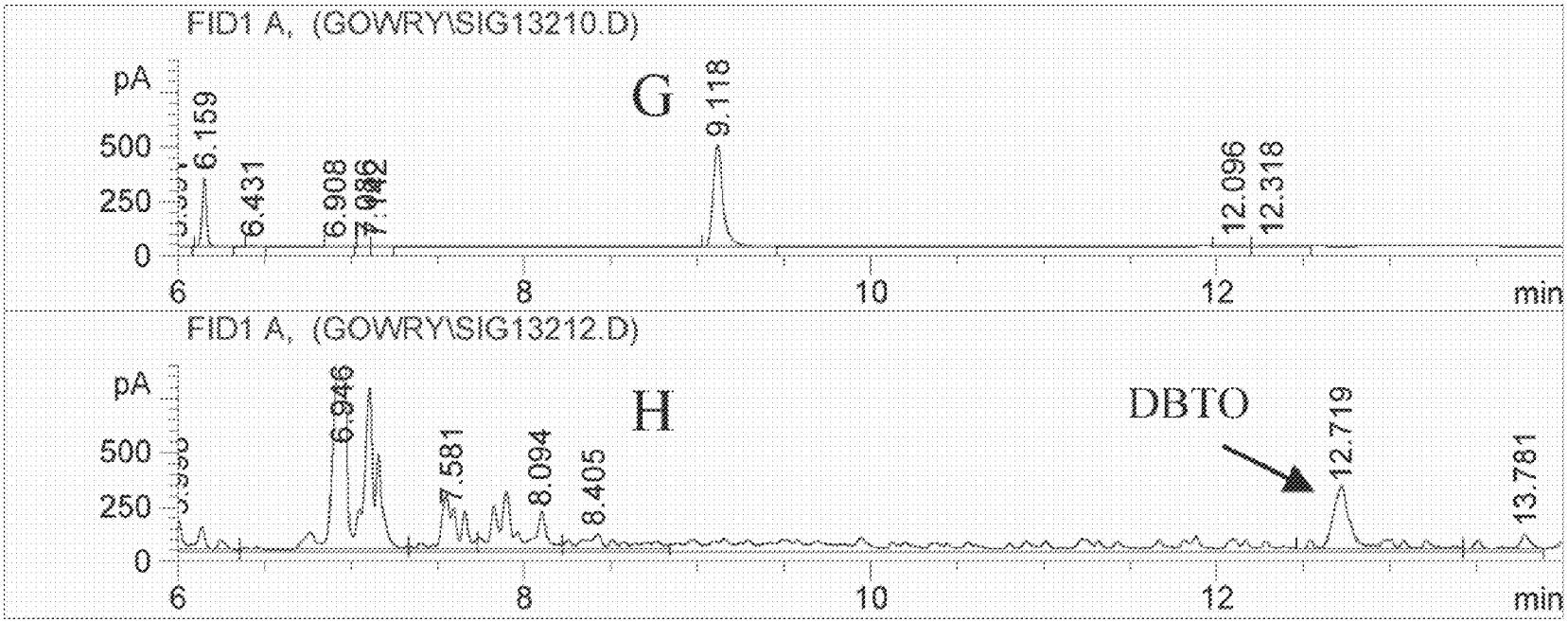

FIGS. 6A to 6H show the individual gas chromatograms of specific samples of treated model diesel. In the experiments carried out for the results shown in FIGS. 6A & B, the catalyst used was 5% $MnO_2/\gamma$-alumina. Treatment temperature was 130° C. FIG. 6A shows the analysis result before treatment, while FIG. 6B shows the analysis result after treatment. FIGS. 6C & 6D show the GC results of model diesel treated in the absence of catalyst at a temperature of 130° C., before treatment and after 18 hours of treatment, respectively. No oxidation was observed. FIGS. 6E & 6F show the GC analysis results of model diesel treated with 5% $MnO_2/\gamma$-alumina catalyst at a temperature of 150° C., before treatment and after 18 hours of treatment, respectively. FIGS. 6G & 6H show the GC analysis results of model diesel treated with 8% $MnO_2/\gamma$-alumina catalyst at a temp. 150° C., before treatment and after 18 hours of treatment, respectively.

Figure 7:
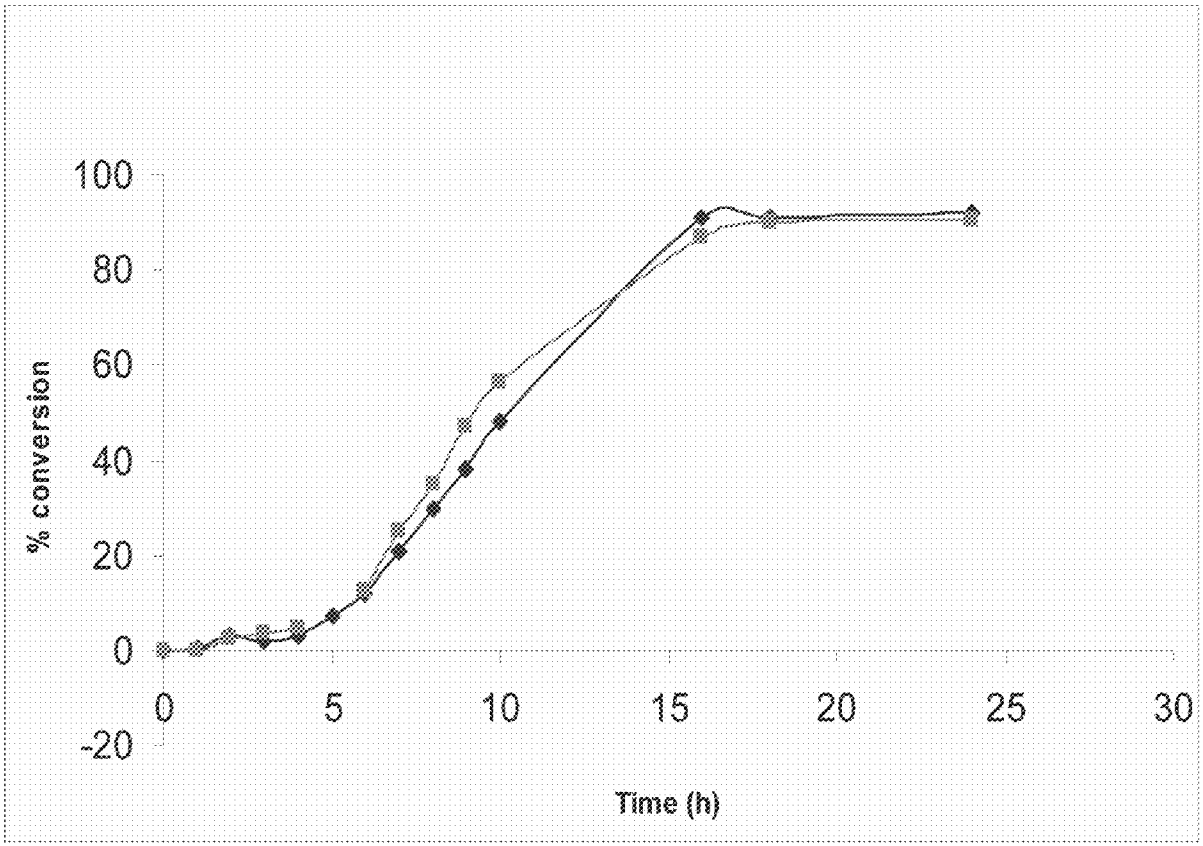

FIG. 7 shows the conversion (in %) of DBT vs. time (in h) in model diesel at 130° C. for manganese (■)- and cobalt (♦)-containing catalysts.

Figure 8A:
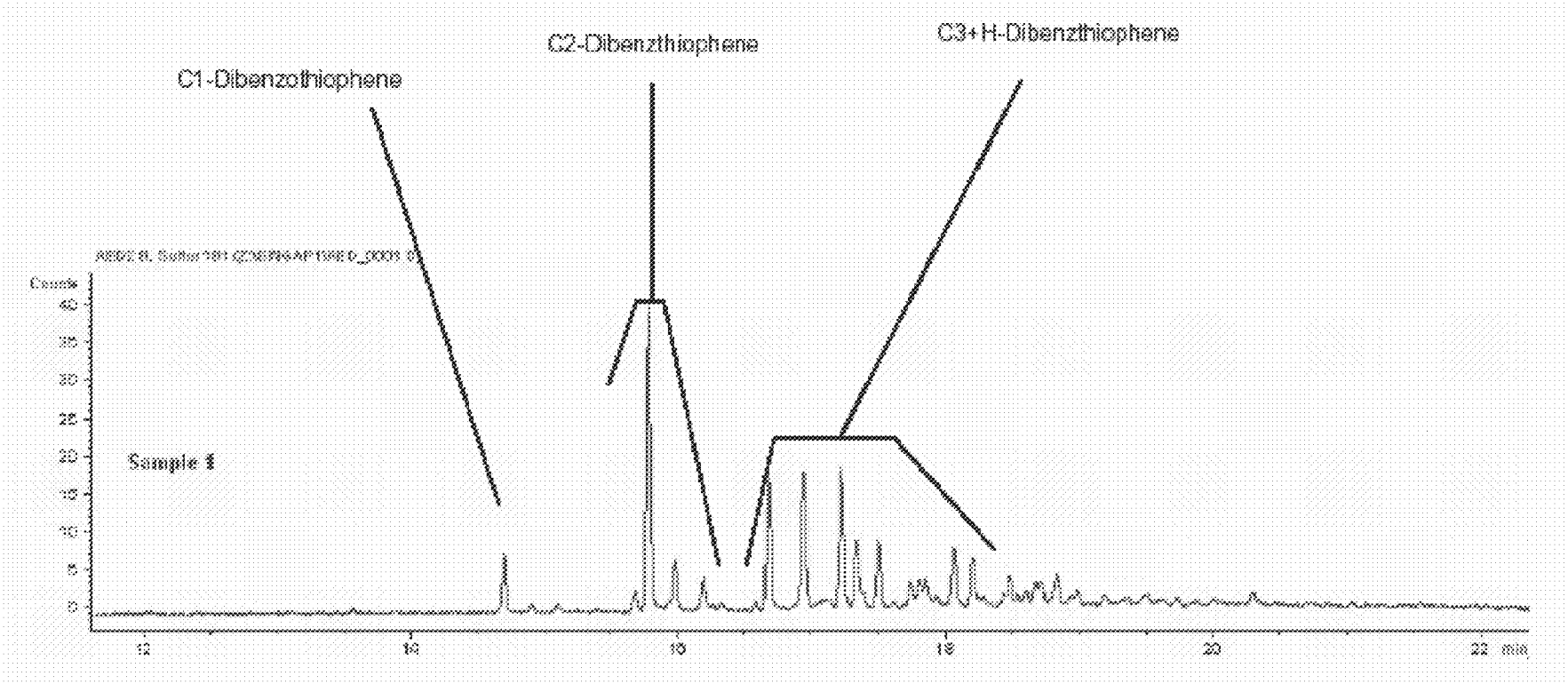

FIG. 8A shows the gas chromatography-atomic emission detection (GC-AED) chromatogram of untreated real diesel used in the examples. FIG. 8B shows a table of data from X-ray florescence (XRF) analysis of sulfur content in untreated diesel that has undergone only solvent extraction.

FIG. 9 shows a table of data from XRF analysis of sulfur content in real diesel that has been treated with either $Co_3O_4$ or $MnO_2$ catalyst supported on γ-alumina, and solvent extraction carried out with AcN, DMF, NMP and methanol. Treatment temperature was about 130° C.

FIG. 10 shows a table of data from XRF analysis of sulfur content in real diesel that has been treated with $MnO_2$ catalyst supported on γ-alumina, and single or multiple solvent extraction carried out with AcN, DMF, NMP and methanol. Treatment temperature was either 130° C. or 150° C.

Figure 11A:
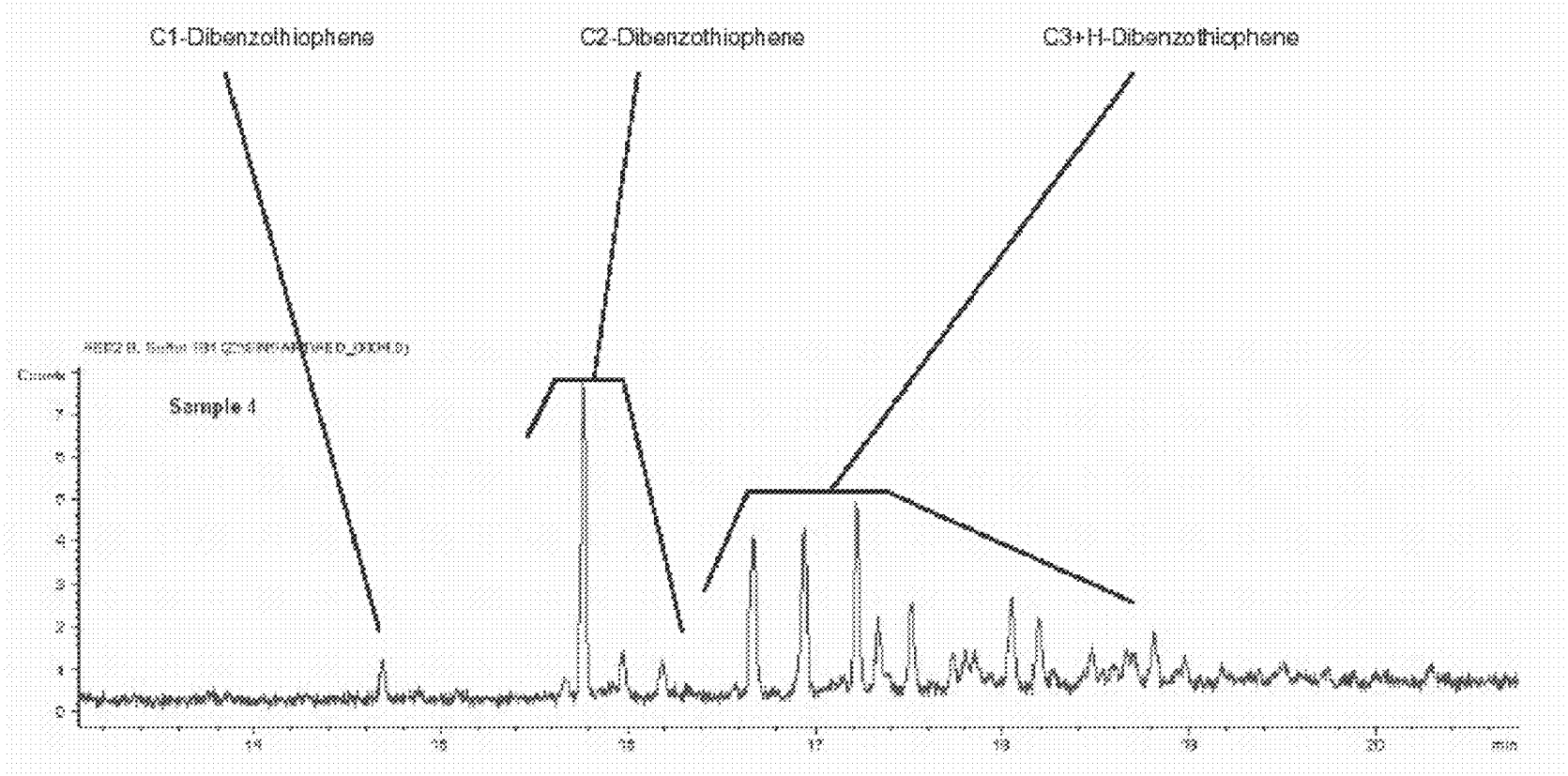
Figure 11B:
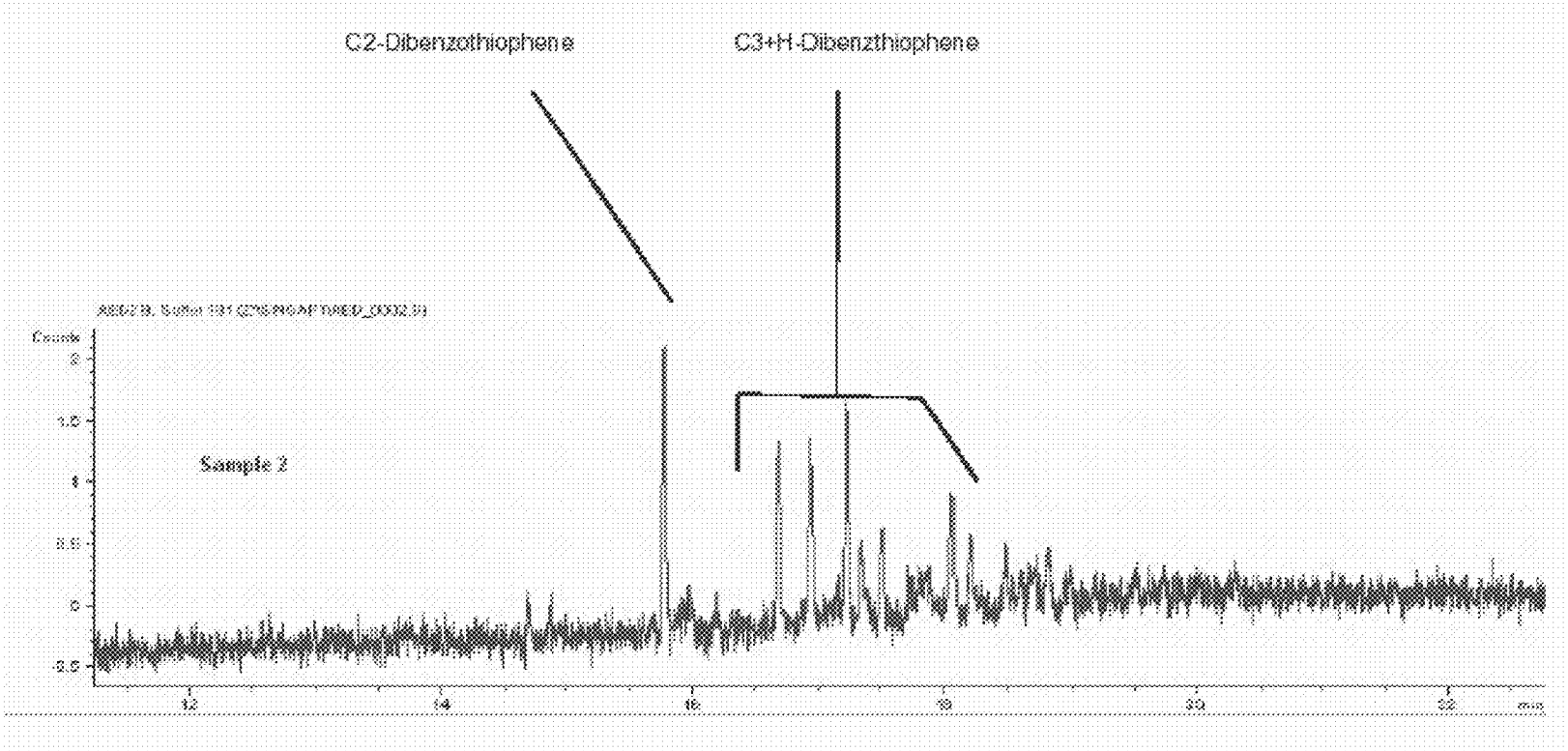
Figure 11C:
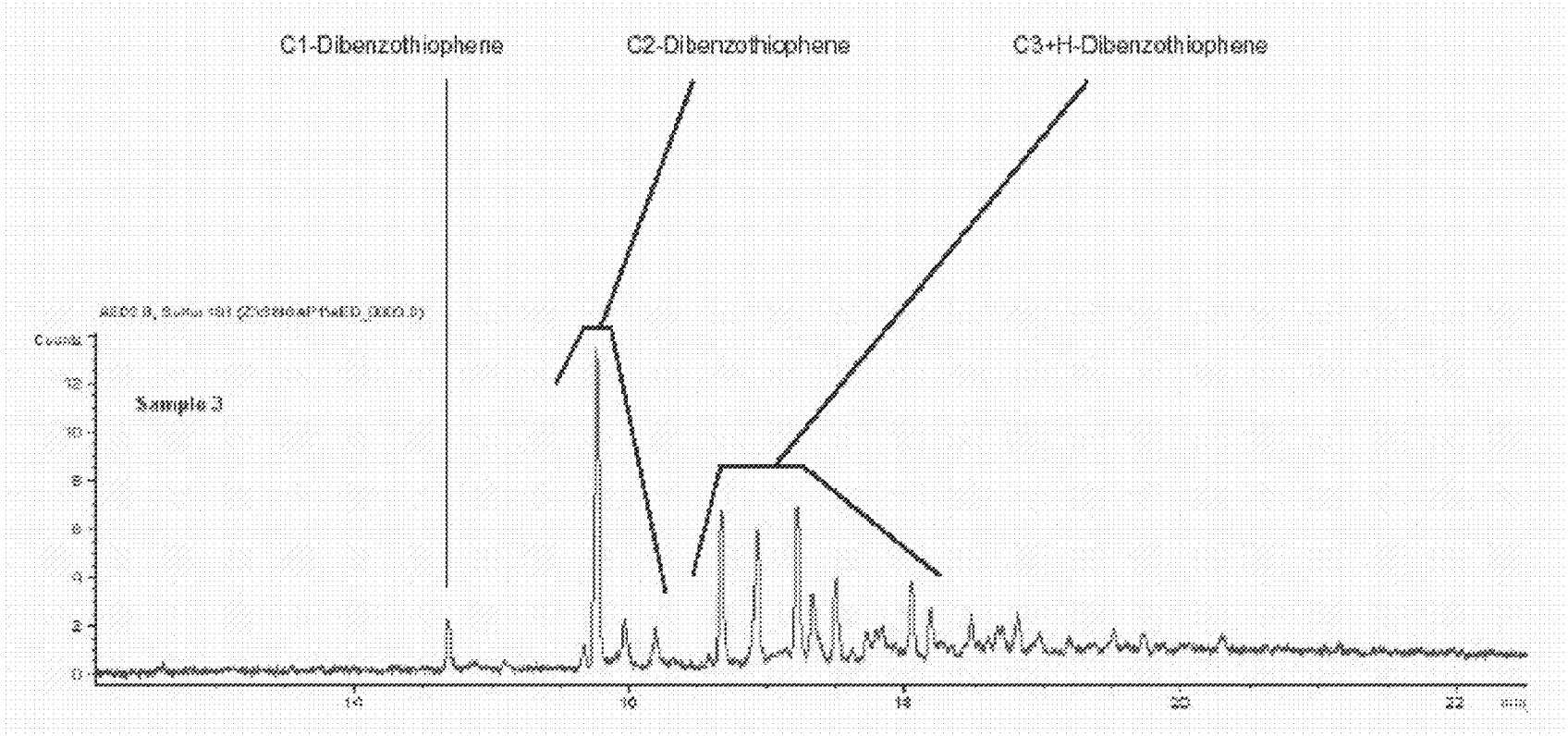

FIGS. 11A to 11C show sulfur AED chromatograms of treated samples marked with superscript 3Ci, 3Cii and 3Ciii in the table in FIG. 10.

FIG. 12 shows a table of data from XRF analysis of sulfur content in real diesel that has been treated with $MnO_2$ catalyst supported on γ-alumina. Comparisons can be made between the effectiveness of sulfur removal employing a single solvent extraction using NMP and without employing any solvent extraction step. Treatment temperature was at 150° C. The initial sulfur content of the real diesel was 440-454 ppm. Sulfur content measurements were taken by ASTM 2622 (Brucker XRF).

Figure 13:
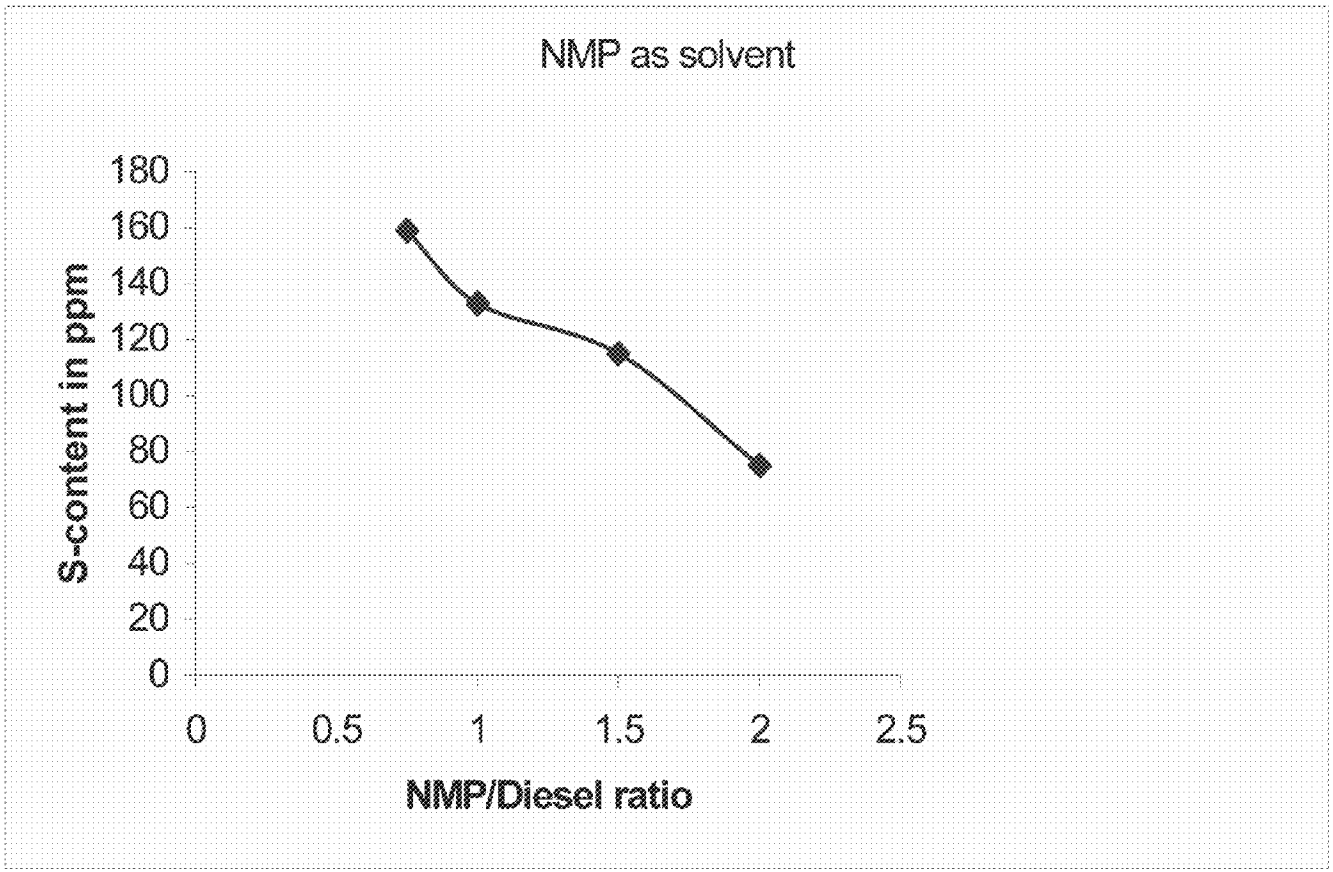

FIG. 13 shows the graph of sulfur content in a treated fuel sample vs ratio of solvent to diesel fuel applied in the solvent extraction process. It will be noted that sulfur content is generally reduced as solvent to fuel ratio is increased.

Figure 14:
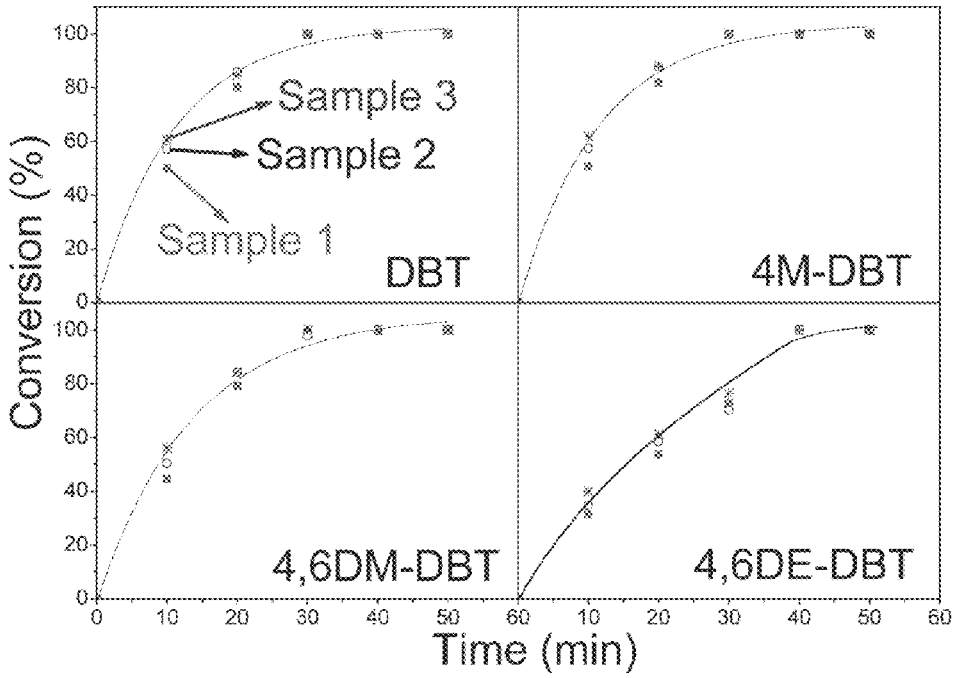

FIG. 14 shows the conversion of (in %) of different dibenzothiophenes (DBT) vs. time (in min) in model diesel. Full oxidation of DBTs into their respective sulfones can be observed after less than 60 minutes using $TiO_2$ supported 20% Mn-10% Mo catalyst (20% Mn-10% Mo/$TiO_2$) (experiments were carried out three times (samples 1 to 3)).

Figure 15:
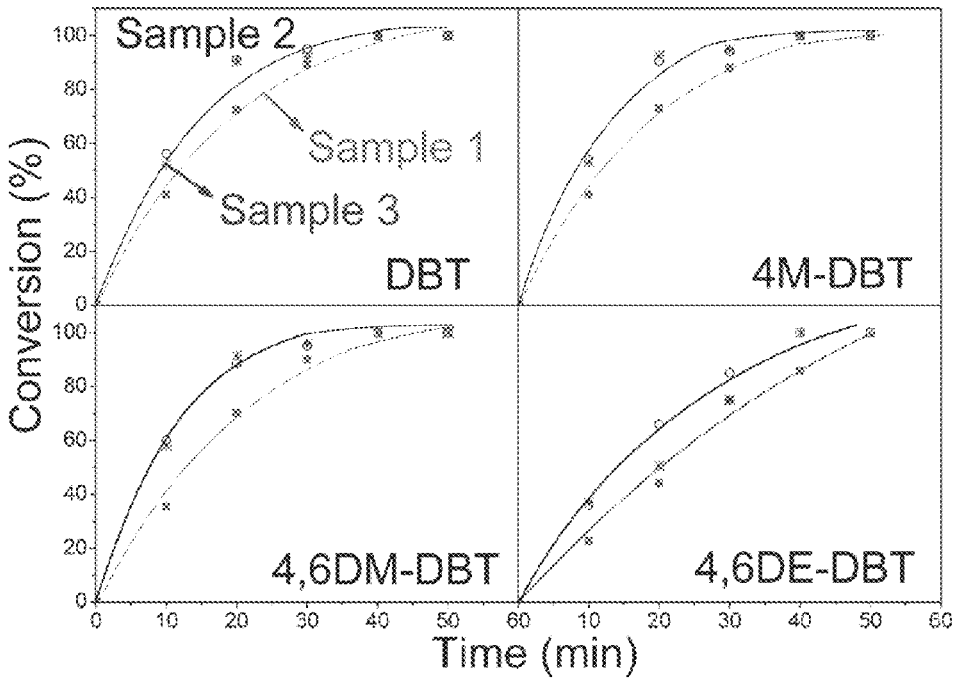

FIG. 15 shows the conversion of (in %) of different dibenzothiophenes (DBT) vs. time (in min) in model diesel. Full oxidation of DBTs into their respective sulfones can be observed after less than 60 minutes using $TiO_2$ supported 7% Mn-6% Mo catalyst (7% Mn-6% Mo/$TiO_2$) (experiments were carried out three times (samples 1 to 3)).

Figure 16:
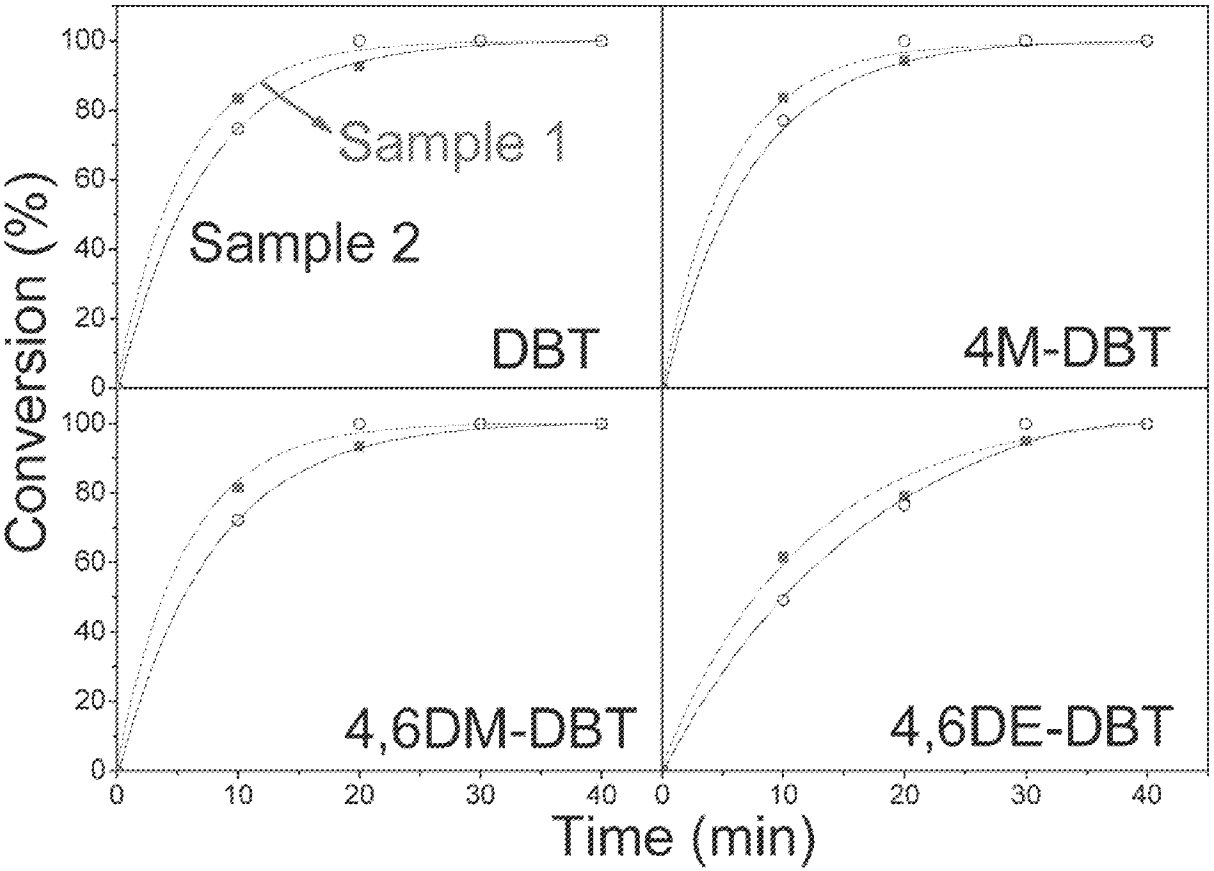

FIG. 16 shows the conversion of (in %) of different dibenzothiophenes (DBT) vs. time (in min) in model diesel. Full oxidation of DBTs into their respective sulfones can be observed after less than 50 minutes using $\alpha$-$Mn_2O_3$ supported 12% Mo catalyst (12% Mo/$\alpha$-$Mn_2O_3$) (experiments were carried out two times (samples 1 and 2)).

Figure 17B:
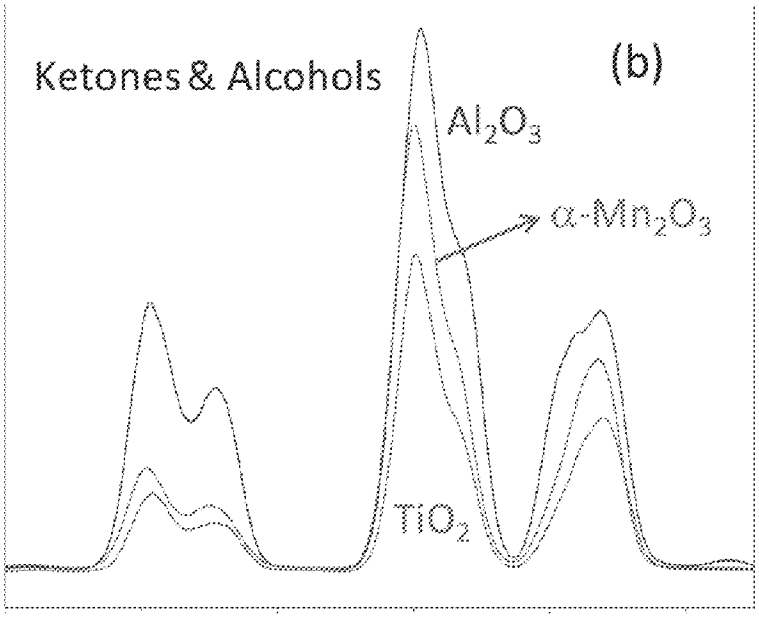
Figure 17A:
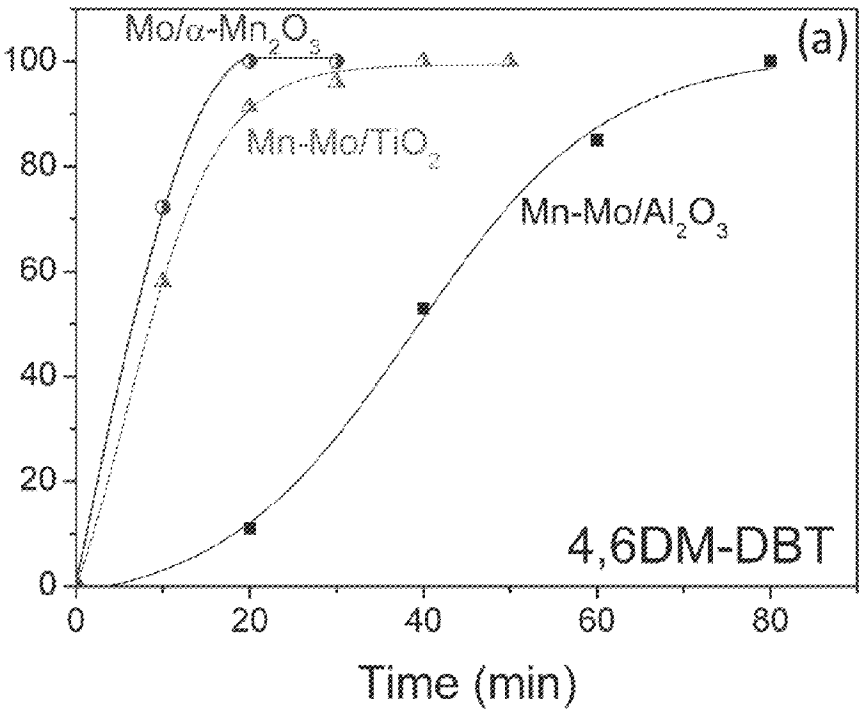

FIG. 17(*a*) shows the conversion of (in %) of 4,6-dimethyldibenzothiophene (dmDBT) vs. time (in min) in model diesel. For this experiment $TiO_2$, $\alpha$-$Mn_2O_3$ and $Al_2O_3$ supported catalysts have been used. FIG. 17(*b*) shows the results of a GC-FID analysis of fully oxidized model diesel which demonstrates that the use of $TiO_2$, $\alpha$-$Mn_2O_3$ supported catalysts decreases the formation of side products, such as ketones and alcohols.

FIG. 18 shows the conversion of (in %) of different dibenzothiophenes (DBT) vs. time (in min) in real diesel. In this experiment $\alpha$-$Mn_2O_3$ supported 12% Mo catalyst (12% Mo/$\alpha$-$Mn_2O_3$) and $TiO_2$ supported 20% Mn-10% Mo catalyst (20% Mn-10% Mo/$TiO_2$) have been used (experiments were carried out two times (samples 1 and 2)).

Figure 19:
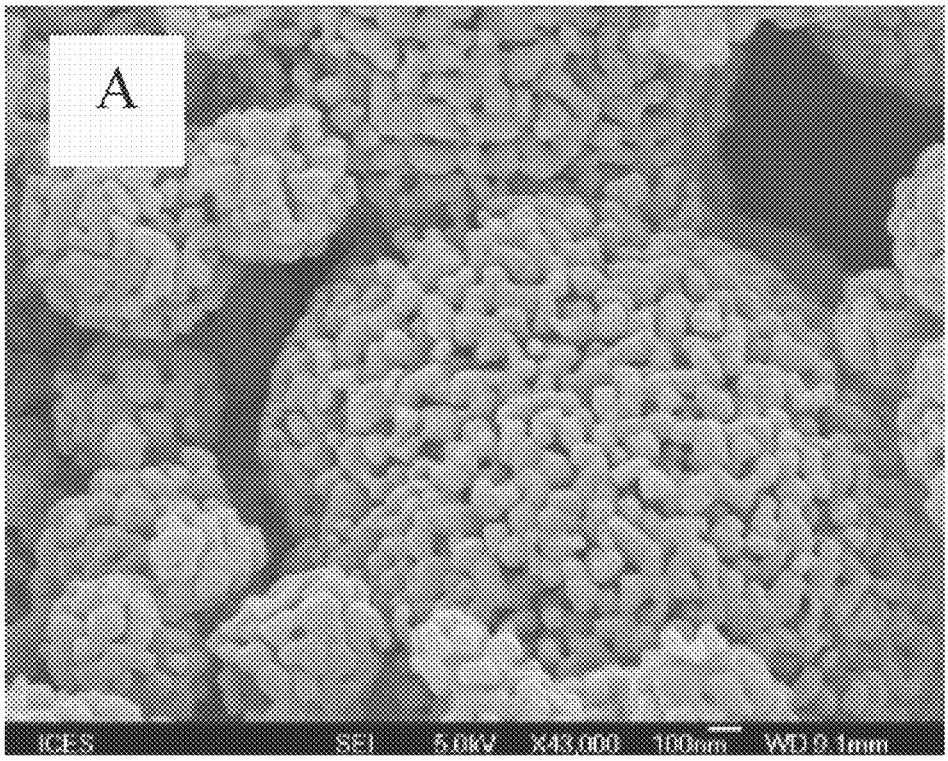

FIG. 19 shows an SEM picture of a coral-like $Mn_2O_3$ nanostructure which has been prepared by oxidative decomposition at 700° C. (Yi-Fan Han, et al., 2008, Catalysis Today, vol. 131, pp. 35); scale bar 100 nm.

EXAMPLES

Example 1

Catalyst Preparation and Characterization

The catalysts to be prepared comprise transition metal oxides and porous support with high specific surface area have been prepared by impregnation using incipient wetness method. 10 g of γ-alumina pellet (diameter=3-4 mm, length=6-10 mm, specific surface area ($S_g$)=370 $m^2/g$, specific pore volume ranged from 0.82 ml/g to 0.87 ml/g) was impregnated with cobalt nitrate and/or manganese acetate aqueous solutions. The total metal oxides loading with respect to γ-alumina ranged from 2 to 13 wt %. The impregnated sample was left on the roller which was set at 25 rpm for approximately 18 h to obtain better dispersion. The sample was then dried at 120° C. in the oven for 18 h for removal of the water content. The dried sample was calcined in a static furnace at 550° C. for 5 hours with a ramp of 5° C./min. Powder X-ray diffraction (XRD) showed that the catalysts were amorphous and that no distinguishable crystallographic properties could be observed among the catalysts. The prepared catalysts were also characterised by $N_2$ adsorption/desorption, and thermogravimetric analysis (TGA) in order to obtain the information on surface area, pore size distribution and pore volume, crystallography and thermal decomposition of the samples. The BET method of measurement were used to determine the catalyst surface area. The characterization data for the prepared catalysts used in the subsequent examples are summed up in the table in FIG. 4.

Example 2

Oxidative Desulfurization with Solvent Extraction Using a Model Diesel

DBT and/or 4-MDBT were chosen to prepare model diesel by dissolving them in n-tetradecane with a total sulfur content of 500-800 ppm. In most of the experiments, sulfur content in the model diesel was introduced by adding only DBT. In the remaining experiments, both 4-MDBT and DBT were added. The oxidation experiments were carried out in a stirred batch reactor.

In a two-necked round bottom flask, 10.0 ml of model diesel containing approximately 500 ppm of sulfur underwent oxidative reaction in the presence of 20-30 mg of the catalyst (diameter=3-4 mm, length=6-10 mm). The mixture was magnetically stirred to ensure a good mixing and bubbled with purified air at flow of 60 ml/min. The reactions were carried out at a temperature range of 90-200° C. The optimum temperature for this specific set up was found to be 130° C. at which the oxidation of the model compounds occurred successfully with insignificant side-reaction of solvent oxidation. A water-cooled reflux condenser was mounted on top of the reaction flask to prevent solvent loss and also function as an outlet for air.

Figure 1:
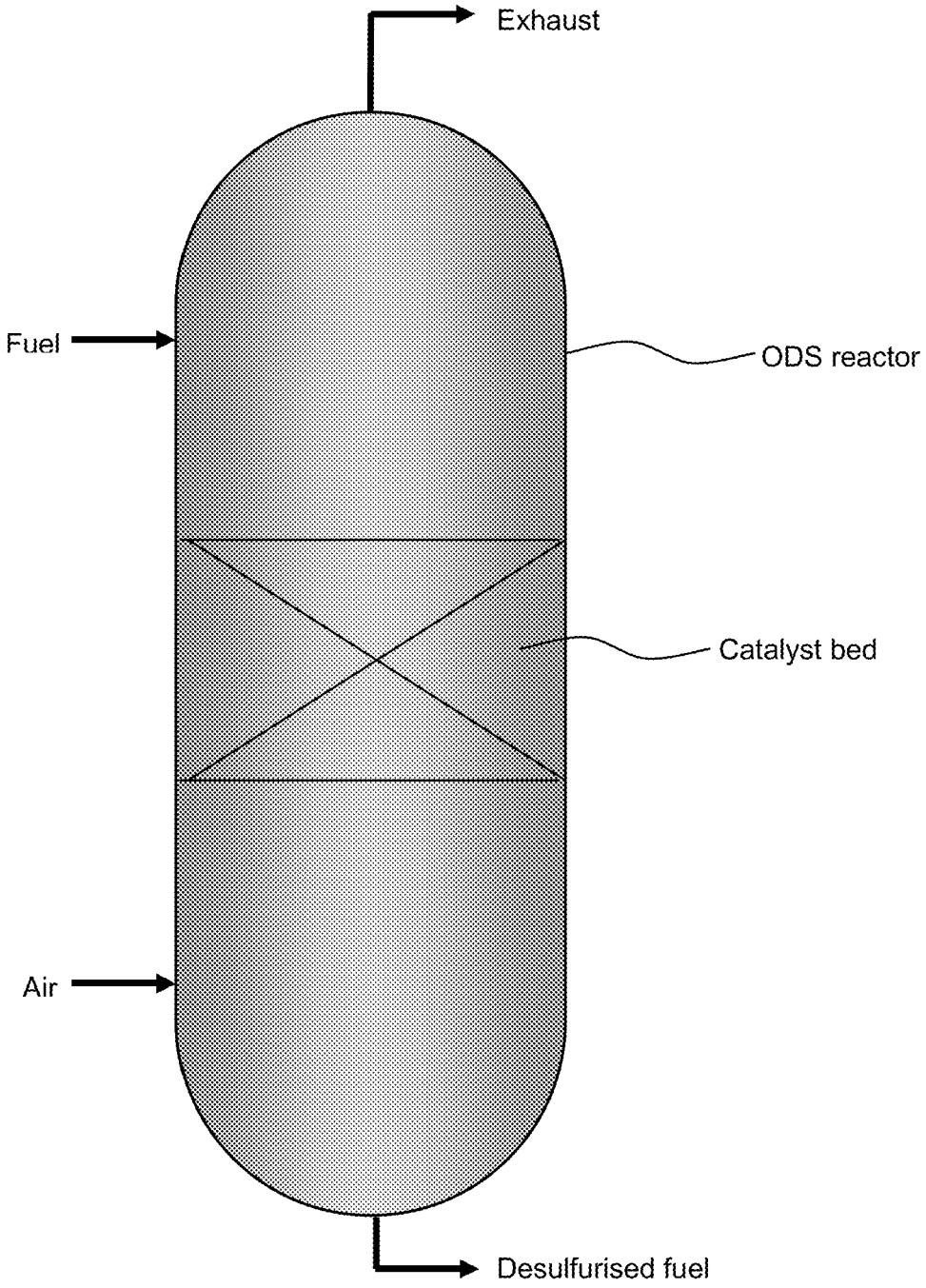
Figure 2:
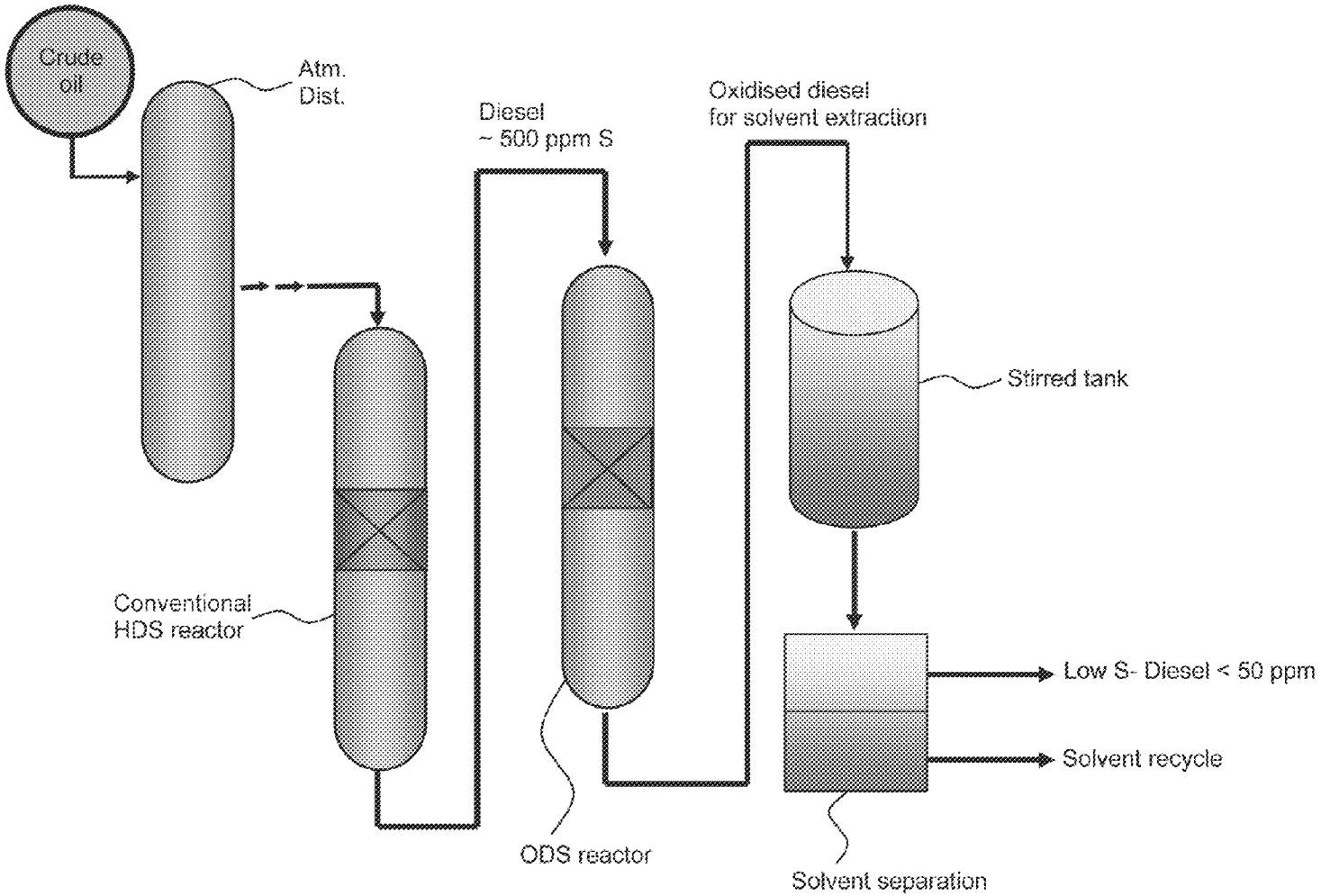
Figure 3:
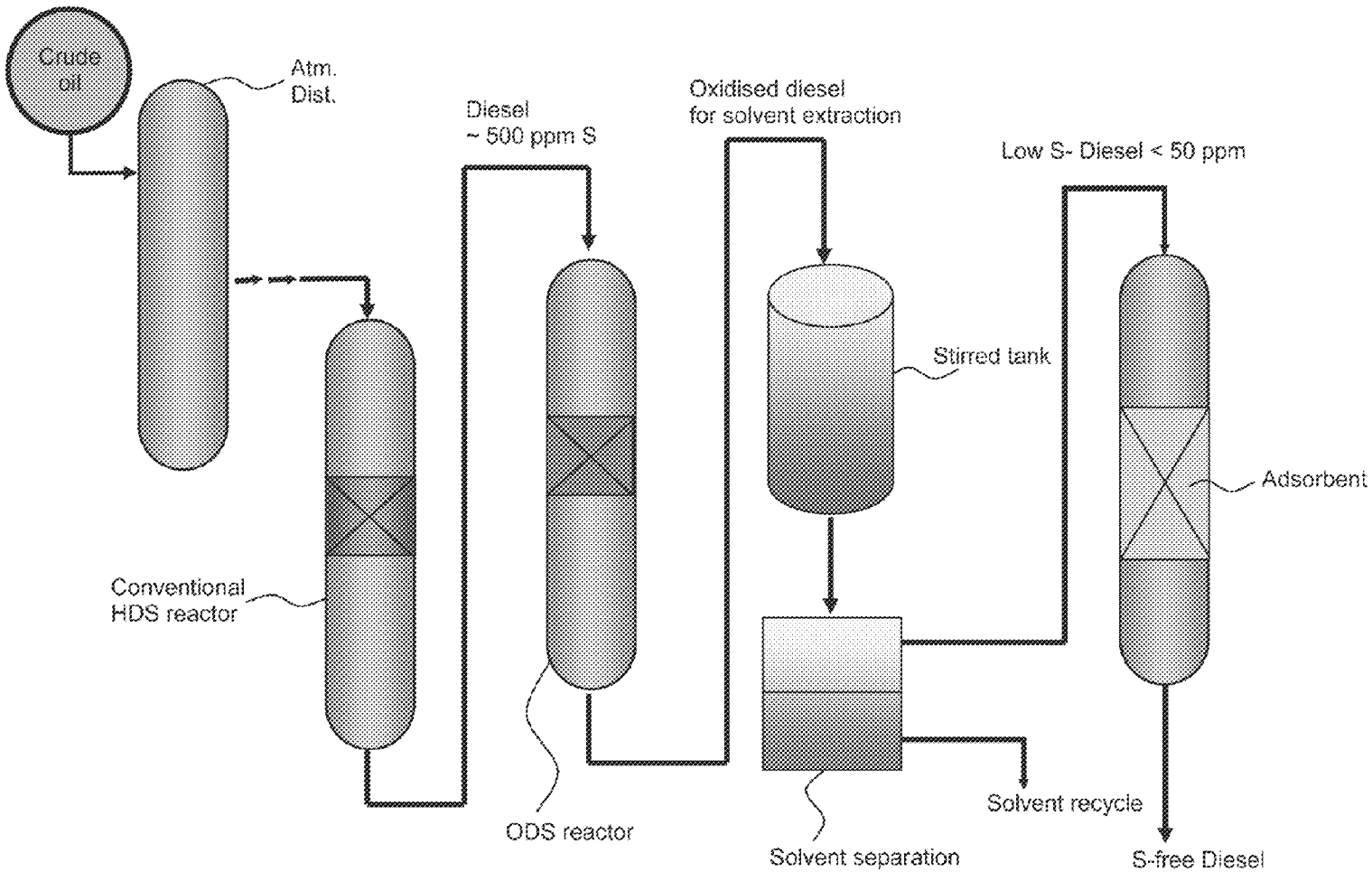
FIG. 3 shows another embodiment of the process shown in FIG. 2, in which the treated fuel is further passed through basic adsorbent column for further removal of the remaining sulfur-containing (which is slightly acidic in nature) compounds in the fuel. The fuel passing out of the adsorption column is sulfur-free.
Figure 5:
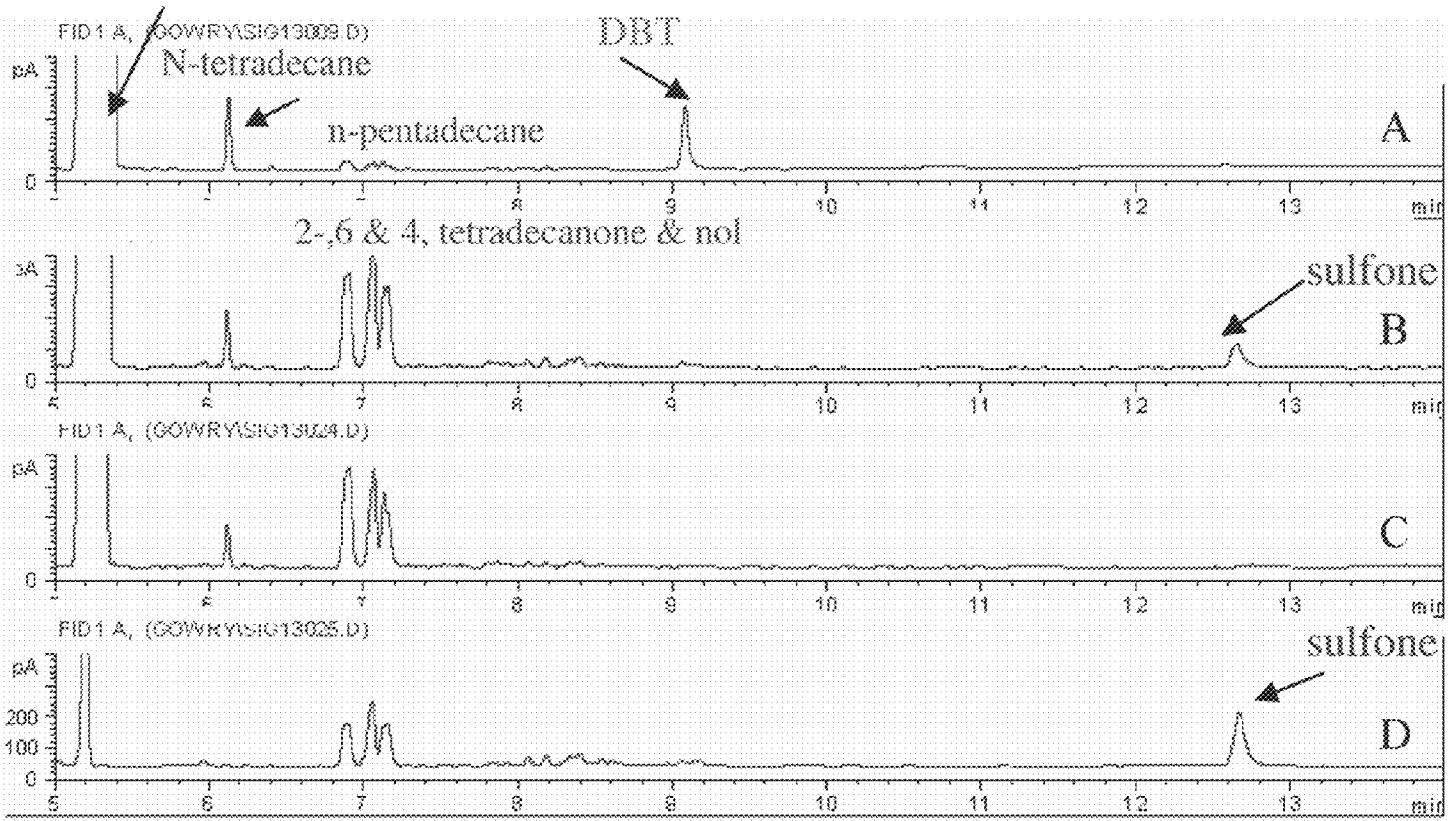

At different time intervals (3 h), 50 μl of the reacted diesel was withdrawn and diluted with 500 μl of diethylether for gas chromatography analysis. After the oxidation reaction, the oxidized products in the model diesel were extracted with polar organic solvents such as methanol, N,N-dimethylformamide (DMF), acetonitrile (AcN) and 1-methyl-2-pyrrolidone (NMP). During this process, the reacted model diesel was mixed with these polar organic solvents at different volume ratios (e.g., organic phase:polar solvent=4:1 as shown in FIG. 5D) and was magnetically stirred vigorously for 1 h. The mixture was then transferred into a separating funnel for the model diesel and polar organic solvent to be separated into different layers. The thus-treated model diesel was analyzed with GC. The sulfur-containing polar solvent layer was then collected and analyzed by GC. In the case of using methanol, the methanol solvent was removed by the rotary evaporator. The remaining solid product was collected and analyzed by the GC after re-dissolving into methanol or NMP (1-methyl-2-pyrrolidone) solvent.

FIGS. 5A to 5D shows the results of sulfur analysis from a gas chromatography-atomic emission detector (GC-FID) of the model diesel before and after the oxidative process of the present invention carried out on model diesel. As shown in the results, almost complete conversion of DBT to the corresponding sulfone was achieved (cf. FIGS. 5A and 5B). A small percentage (about 5%) of n-tetradecane was oxidized to 6-tetradecanone, 2-tetradecanone and 4-tetradecanol. These are termed oxygenates and are known to enhance diesel quality. It was found that NMP and DMF were better solvents than methanol and AcN. NMP solvent extraction achieved almost complete removal of the sulfones (cf. FIGS. 5C and 5D, in which a diesel:solvent volume ratio of about 4:1 was used). Additionally, multiple extractions were found to be better than a single extraction.

In a further experiment, specific samples of the model diesel were treated with different $MnO_2$ catalysts having different catalyst loading levels, and at temperatures of either 130° C. or 150° C. The treated diesel samples were analyzed with gas chromatography (GC-FID) before the start of the oxidative treatment and after 18 hours of reaction time in order to determine the catalytic activity of the catalyst for oxidation reaction using air as oxidant at 130° C. (FIGS. 6A and 6B).

In a similar experiment carried out without catalyst, it was observed that the reaction could not proceed (FIGS. 6C and 6D). The result of the analysis are shown in FIGS. 6A to 6H. In summary, FIGS. 6A-6D show that the catalyst is important for the selective oxidation of dibenzothiophene to corresponding sulfone at 130° C. FIGS. 6E-6H further show that the catalytic activity of 5-8% $MnO_2$ loaded on gamma alumina for model diesel and a reaction temperature of 150° C. provide advantageous conditions for selective oxidation of dibenzothiophene without oxidizing the hydrocarbons such as tetradecane or pentadecane.

As can be seen from FIG. 7 showing the conversion of DBT throughout the oxidative treatment, conversion reached above 90% between the reaction time of 15 hr to 18 hr.

Example 3

Oxidative Desulfurization and Solvent Extraction on Real Diesel

A) Solvent Extraction on Diesel without Oxidative Treatment

Four 25.0 ml samples of untreated diesel was mixed with the polar organic solvents AcN, DMF, NMP and MeOH, respectively, in order to determine the effect of solvent extraction on sulfur compounds present in untreated fuel. After extraction by the respective polar solvents, the sulfur content of the diesel was measured by X-ray florescence (XRF). Untreated diesel had sulfur content of 370-380 ppm before extraction was carried out (measured by XRF using s-standard calibration curve). The GC-AED analysis of the sulfur content in the diesel is shown in FIG. 8A. The results in FIG. 8B show that among the solvents tested, NMP was most efficient in extracting sulfur compounds present in untreated fuel.

B) Oxidative Treatment Using $Co_3O_4$ and $MnO_2$ Catalysts Supported on γ-Alumina Followed by Solvent Extraction In a two-necked round flask, 100 ml real diesel underwent oxidative reaction in the presence of about 100 mg of catalyst. The mixture was magnetically stirred to ensure a good mixing and bubbled with purified air at flow of 60 ml/min. The reactions were carried out at 130° C. The reaction was stopped after about 18 hours. The oxidized diesel was cooled to room temperature and divided into four portions of 25 ml each for extraction using different solvents (different volume). The analysis results are shown in FIG. 9. Sulfur content of the extracted oxidized real diesel was measured by XRF using s-standard calibration curve. Judging from this experiment, an 8% $MnO_2$ supported catalyst appeared to be more effective for removing sulfur from diesel than a 2% or 5% supported $MnO_2$ catalyst.

C) Oxidative Treatment Using $MnO_2$ Catalysts Supported on γ-Alumina Followed by Single or Multiple Solvent Extraction In a two-necked round flask, 150 ml real diesel underwent oxidative reaction in the presence of about 30 mg of catalyst. The mixture was magnetically stirred to ensure a good mixing and bubbled with purified air at flow of 60 ml/min. The reactions were carried out at a temperature of either 130° C. or 150° C. The reaction was stopped after about 18 hours. The oxidized diesel was cooled to room temperature and divided into five portions of 30 ml each for extraction using different solvents (different volume) via either single or multiple solvent extraction.

The analysis results are shown in FIG. 10. Sulfur-content of the extracted oxidized real diesel was measured by XRF using s-standard calibration curve. Sulfur ppm levels indicated within the brackets ( ) were measured using Antek 9000S (Singapore Catalyst Centre) ASTM D-5453 method. It can be seen that at a treatment temperature of 130° C., $MnO_2$ supported catalysts provided better sulfur removal at a loading level of 5% than at a loading level of 2%. Oxidative treatment carried out at a temperature of 150° C. and using catalysts at a loading level of 8% provided better sulfur removal than treatments carried out at 130° C. using catalysts having lower loading levels. Additionally, multiple solvent extractions were able to provide better sulfur removal than single solvent extractions.

Sulfur AED chromatograms were also obtained for specific treated samples (marked with superscript 3Ci, 3Cii and 3Ciii in the above figure) and are shown in FIGS. 11A to 11C.

D) Effect of Solvent Extraction on Sulfur Removal after Carrying Out Oxidative Treatment Using $MnO_2$ Catalysts Supported on γ-Alumina In a two-necked round flask, 150 ml real diesel underwent oxidative reaction in the presence of various amounts of catalyst. The mixture was magnetically stirred to ensure good mixing and bubbled with purified air at flow of 60 ml/min. The reactions were carried out at 150° C. for a period of about 24 hours. The oxidized diesel was cooled to room temperature and divided into five portions of 30 ml each. Each 30 ml portion was divided into two portions. One portion of each oxidized diesel sample was analyzed after oxidative treatment but prior to solvent extraction to determine the amount of $SO_2$ (gas) released during the oxidation process. The other portion of each of the samples underwent solvent extraction using 50 ml of a respective solvent and then analyzed for sulfur content (Bruker XRF using S-standardless method, ASTM 2622).

Based on the results shown in FIG. 12, it can be seen that at a oxidation temperature of 150° C., sulfur removal provided by $MnO_2$ supported catalysts was most effective at a loading level of 8%, as compared to other loading levels of 5%, 11% or 13%.

Example 4

Oxidative Desulfurization of Model Diesel Using $TiO_2$ Supported Catalysts $TiO_2$ supported catalysts were prepared by wet impregnation. A commercial $TiO_2$ (P-25 from Degussa, Specific surface area ($S_g$)=50 $m^2/g$) was impregnated using aqueous solution of Ammonium heptamolybdate tetrahydrate, $(NH_4)_6Mo_7O_{24}.4H_2O$ (Merck), and Mn (II) acetate tetrahydrate 99+% (Alfa Aesar). A typical 20% Mn-10% Mo sample was prepared as follows: ~15.3 g Mn(II) acetate and ~3.2 g $(NH_4)_6Mo_7O_{24}.4H_2O$ were dissolved in 100 ml of distilled (DI) water, respectively. Both solutions were mixed, adding ~80 ml of 1M HCl to prevent precipitation, and stirred for a few minutes. This solution was used to impregnate 12 g of $TiO_2$ (P25), after drying it overnight at 120° C. The mixture was stirred using a rotary evaporator at 130 rpm during 2 hours at room temperature and, then, the solvent was slowly evaporated at 50° C. The impregnated sample was subsequently dried overnight in an oven at 120° C. and, finally, calcined at 550° C. during 3 hours, using a heating rate of 5° C./min. Using a similar procedure, a 7% Mn-6% Mo/$TiO_2$ catalyst was also prepared.

The resulting catalysts were tested in the catalytic oxidation of dibenzothiophenes into the corresponding sulfones. Oxidation experiments were carried out with 50 ml of model diesel (~400 ppm sulfur content) in a refluxed three-neck round bottom flask. Model Diesel was obtained by dissolving equimolar amount of dibenzothiophene, 4-methyl dibenzothiophene, 4,6-dimethyl dibenzothiophene and 4,6-diethyl dibenzothiophene in hexadecane (C16) in order to achieve a total sulfur concentration of 400 ppm. In addition, mono and di-aromatic compounds were also added (n-hexylbenzene: 8%, n-heptylbenzene: 8% and naphthalene: 3.8%).

Approximately 0.5 g of catalyst was used. The reactions were carried out at 160° C., during which purified air was introduced via a metal sparger at a constant flow rate of 100 ml/min while the reaction mixture was magnetically stirred throughout the experiment to ensure a good mixing. A water-cooled reflux condenser was mounted on top of the reaction flask to prevent solvent loss and serve as an air outlet. The progress of the reaction was monitored periodically withdrawing ~1 ml aliquots of the reaction mixture. The aliquots were then filtered before either GC-AED or GC-FPD analysis.

FIGS. 14 and 15 show the conversion-time curves for 20% Mn-10% Mo/$TiO_2$ and 7% Mn-6% Mo/$TiO_2$ catalysts, respectively. An excellent catalytic performance is exhibited by both catalysts. Indeed, full oxidation can be achieved in less than 1 h.

Example 5

Oxidative Desulfurization of Model Diesel Using Nano-structured α-$Mn_2O_3$ as a Support Nano-structured α-$Mn_2O_3$ was obtained by controlled thermal decomposition of $Mn(CO_3)$ at 500° C. as reported by Han, Y.-F., Chen, L., Ramesh, K., et al. (2008, Catalysis Today, vol. 131, p. 35-41). Nano-structured α-$Mn_2O_3$ ($S_g$=40-50 $m^2/g$) (see FIG. 19) was impregnated using aqueous solution of Ammonium heptamolybdate tetrahydrate, $(NH_4)_6Mo_7O_{24}.4H_2O$ (Merck) as previously described. Typically, a 12% Mo/α-$Mn_2O_3$ was prepared as follows: 10 g of $Mn_2O_3$ support was dried overnight in an oven at 120° C. 2.5 g of $(NH_4)_6Mo_7O_{24}.4H_2O$ was dissolved in 10 ml of DI water. Then, the α-$Mn_2O_3$ support was impregnated with the Mo precursor using incipient wetness impregnation (IWI) method. The impregnated sample was then placed in a roller at 30 rpm overnight (>18 h). The sample was subsequently dried overnight at 120° C. and finally calcined at 550° C. for 3 h with a heating rate of 5° C./min The resulting catalyst was tested as described in Example 4. FIG. 16 shows the conversion-time curves for two samples with similar Mo loading. An outstanding catalytic performance is exhibited by both catalysts, achieving full oxidation in 30 min.

Example 6

Oxidative Desulfurization of Model Diesel Using a-$MnO_2$ Nanorods as a Support Material Porous α-$MnO_2$ was synthesized using a template-free method. Typically, 30 ml of a 0.01 M solution of $Mn(CH_3COO)_2$ were added to 20 ml solution of $KMnO_4$ 0.01 M under stirring. The pH was adjusted by adding 1 ml of HCl 1 M. The resulting mixture was transferred into a Teflon lined autoclave and heated up at 180° C. during 1 h. After cooling down to room temperature, the precipitate was filtered, washed with distilled water thoroughly, and finally dried overnight at 120° C. Molybdenum (Mo) was loaded onto the $\alpha$-$MnO_2$ nano-rods by incipient wetness impregnation method as previously described. Typically, the Mo loading was 6%. After drying overnight at 120° C., the impregnated sample was calcined at 400° C. during 3 h.

The resulting catalyst was tested as previously described, using a 500 ppm solution of 4,6 dimethyl dibenzothiophene in tetradecane as model diesel. The catalyst shows a good catalytic performance, fully oxidizing the 4,6-dimethyl dibenzothiophene in less than 1 h at 150° C.

Example 7

Comparative Oxidation Study Using $TiO_2$, a-$Mn_2O_3$, and $Al_2O_3$-Supported Catalysts Three different supported catalysts, prepared as previously described, were tested under identical reaction conditions using the model diesel described in Example 4. FIG. 17(*a*) shows the conversion-time curves. It is clear that both $TiO_2$ and $\alpha$-$Mn_2O_3$-supported catalysts exhibit a higher catalytic activity as compared to the one supported on $Al_2O_3$. As mentioned in Example 2, a small fraction of the model diesel was oxidized to produce mainly ketones and alcohols, which can be identified by GC-FID analysis. In order to characterize the side product formation, the full oxidized model diesels obtained using the three different catalysts were analyzed by GC-FID. FIG. 17(*b*) shows only the region of the GC-FID chromatograms where those side products appear. It is clear that both $TiO_2$ and $\alpha$-$Mn_2O_3$-supported catalysts significantly decrease the formation of side products.

Example 8

Oxidative Desulfurization of Real Diesel Using $TiO_2$ and a-$Mn_2O_3$ Supported Catalysts $TiO_2$ and $\alpha$-$Mn_2O_3$ supported catalysts where tested using real diesel. Oxidation experiments were carried out with ~400 ml of real diesel (~260 ppm sulfur) in a 1 l autoclave. Approximately 10 g of catalyst was used. The reactions were carried out at 160° C. and 20 bar, introducing air at a constant flow rate of 100 ml/min while the reaction mixture was stirred throughout the experiment to ensure a good mixing. The progress of the reaction was monitored periodically withdrawing ~2-3 ml aliquots of the reaction mixture. The aliquots were then filtered before either GC-AED or GC-FPD analysis.

FIG. 18 shows the conversion-time curves for 12% Mo/$\alpha$-$Mn_2O_3$ and 20% Mn-10% Mo/$TiO_2$ catalysts, respectively. Only the conversion of the two main sulfur-containing compounds present in the real diesel (sulfur content 260 ppm), 4,6-dimethyl dienzotiophene and 4,6-diethyl dibenzothiophene, is reported. Both catalysts show good performance, achieving full oxidation in a reasonable shot time (1-2 h).

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A process for removing sulfur-containing compounds from fuel, said process comprising:

contacting the fuel in liquid phase with air to oxidize the sulfur-containing compounds, said contacting being carried out in the presence of at least one transition metal oxide catalyst;

wherein the catalyst is supported on a porous support and wherein the porous support comprises a support material selected from the group consisting of a titanium oxide, a manganese oxide and a nanostructured material of the aforementioned support materials.

2. The process of claim 1 wherein said contacting is carried out at a temperature range of between about 90° C. to 250° C.

3. The process of claim 1 wherein said contacting is carried out at a pressure of between about 1 bar to 30 bar.

4. The process of claim 1 wherein said contacting is carried out at a pressure of about 1 bar or 20 bar.

5. The process of claim 1 wherein the amount of catalyst supported on the porous support (catalyst loading) is in the range of about 1% to 30% by weight of the porous support.

6. The process of claim 5 wherein the amount of catalyst supported on the porous support (catalyst loading) is in the range of about 1% to 17% by weight of the porous support.

7. The process of claim 5 wherein the amount of catalyst supported on the porous support (catalyst loading) is in the range of about 10% to 30% by weight of the porous support.

8. The process of claim 5 wherein the amount of catalyst supported on the porous support (catalyst loading) is in the range of about 2% to 13% by weight of the porous support.

9. The process of claim 1 wherein said manganese oxide is $\alpha$-$Mn_2O_3$ or $\alpha$-$Mn0_2$.

10. The process of claim 1 wherein said titanium oxide is $TiO_2$.

11. The process of claim 1 wherein the nanostructured material is selected from the group consisting of spheres, cubes, nanotubes, nanowires, nanorods, nanoflakes, nanoparticles, nanodiscs and combinations of the aforementioned nanostructured materials in a mixture.

12. The process of claim 1 wherein the porous support comprises coral-like $\alpha$-$Mn_2O_3$ or $\alpha$-$MnO_2$ nanorods or $TiO_2$ nanotubes or $TiO_2$ nanowires.

13. The process of claim 1 wherein the transition metal is selected from Groups 6, 7, 8 or 9 of the Periodic Table according to IUPAC 1990.

14. The process of claim 11 wherein the transition metal is selected from the group consisting of manganese, cobalt, iron, chromium and molybdenum.

15. The process of claim 1, further comprising:

adding a polar organic solvent to the treated fuel after contacting the fuel with air, thereby extracting the oxidized sulfur-containing compounds from the treated fuel, and separating the polar organic solvent and the oxidized sulfur-containing compounds from the treated fuel.

16. The process of claim 15 wherein the polar organic solvent comprises acetonitrile, N,N'-dimethyl-acetamide, N-methyl-pyrolidinone, trimethylphosphate, hexamethylphosphoric amide, methanol, ethanol, propanol, butanol, pyridine, propylene glycol, ethylene glycol, N,N'-dimethylformamide, 1-methyl-2-pyrrolidone, acetone and mixtures thereof.

17. The process of claim 15 wherein 1 part by volume of polar organic solvent is added to between about 1 to 4 parts by volume of treated fuel.

18. The process of claim 15, further comprising treating the treated fuel with a basic adsorbent.

19. The process of claim 18 wherein the basic adsorbent is selected from the group consisting of zeolites, activated carbon, and layered-double hydroxides (LDH).

20. The process of claim 18, further comprising washing the basic adsorbent with a basic solution to regenerate the basic adsorbent.

21. The process of claim 1 wherein the untreated fuel comprises sulfur content in the range of between about 300 to 800 ppm.

22. The process of claim 1 wherein the fuel is diesel that has been treated in a hydro-desulfurization process.

23. The process of claim 1 wherein the sulfur-containing compounds in the fuel comprise thiophenic compounds.

24. The process of claim 23 wherein the thiophenic compounds are selected from the group consisting of thiophene, benzothiophene, dibenzothiophene, 4-methyl-dibenzothiophene, 4,6-dimethyl-dibenzothiophene and tribenzothiophene, and mono-, di-, tri-, and tetra-substituted compounds thereof.

* * * * *